US011423821B2

(12) United States Patent
Oh et al.

(10) Patent No.: US 11,423,821 B2
(45) Date of Patent: Aug. 23, 2022

(54) DATA DRIVING CIRCUIT AND DISPLAY DEVICE USING THE SAME

(71) Applicant: LG Display Co., Ltd., Seoul (KR)

(72) Inventors: Dae Seok Oh, Paju-si (KR); Yong Won Jo, Paju-si (KR); Yong Woo Yun, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/319,973

(22) Filed: May 13, 2021

(65) Prior Publication Data

US 2021/0366343 A1 Nov. 25, 2021

(30) Foreign Application Priority Data

May 22, 2020 (KR) ..... 10-2020-0061711

(51) Int. Cl.
*G09G 3/20* (2006.01)
*G09G 3/3291* (2016.01)

(52) U.S. Cl.
CPC ..... *G09G 3/2003* (2013.01); *G09G 3/3291* (2013.01); *G09G 2300/0452* (2013.01); *G09G 2300/0828* (2013.01); *G09G 2310/0297* (2013.01); *G09G 2320/0673* (2013.01)

(58) Field of Classification Search
CPC ..... G09G 3/2003; G09G 3/3291; G09G 2300/0452; G09G 2300/0828; G09G 2310/0297; G09G 2320/0673
See application file for complete search history.

(56) References Cited

U.S. PATENT DOCUMENTS

2009/0066681 A1* 3/2009 Kim ..... G09G 3/3685 341/145
2017/0046993 A1* 2/2017 Chang ..... G09G 3/2003

FOREIGN PATENT DOCUMENTS

KR 10-2016-0129181 A 11/2016
KR 10-2018-0104940 A 9/2018
KR 10-2019-0057783 A 5/2019

* cited by examiner

*Primary Examiner* — Kenneth B Lee, Jr.
(74) *Attorney, Agent, or Firm* — Seed IP Law Group LLP

(57) ABSTRACT

A data driving circuit includes a first voltage divider circuit configured to output a gamma compensation voltage for a first color, a second voltage divider circuit configured to output a gamma compensation voltage for a second color, a third voltage divider circuit configured to output a gamma compensation voltage for a third color, a first digital-to-analog converter (DAC) configured to convert input data for the first color using the gamma compensation voltage for the first color to output a data voltage of a first channel, a second DAC configured to convert input data for the second color using the gamma compensation voltage for the second color to output a data voltage of a second channel, and a third DAC configured to convert input data for the third color using the gamma compensation voltage for the third color to output a data voltage of a third channel.

18 Claims, 22 Drawing Sheets

DATA DRIVING CIRCUIT AND DISPLAY DEVICE USING THE SAME

CROSS-REFERENCE TO RELATED APPLICATION

This application claims priority to and the benefit of Korean Patent Application No. 10-2020-0061711, filed on May 22, 2020, the disclosure of which is incorporated herein by reference in its entirety.

BACKGROUND

Technical Field

The present disclosure relates to a data driving circuit for driving a pixel and a display device using the same.

Description of the Related Art

As flat panel display devices, liquid crystal display (LCD) devices, electroluminescence display devices, field emission display (FED) devices, plasma display panel (PDP) devices, and the like are known.

Electroluminescence display devices may be classified into inorganic light-emitting display devices and organic light-emitting display devices depending on materials of an emission layer. An active matrix-type organic light-emitting display device includes an organic light-emitting diode (hereinafter, referred to as "OLED") that emits light by itself and has the advantages of a fast response time, high luminous efficiency, high luminance, and a wide viewing angle. The organic light-emitting display device has OLEDs formed in each pixel. The organic light-emitting display device can represent a black grayscale as perfect black as well as having a fast response time, high luminous efficiency, high luminance, and a wide viewing angle, and thus has an excellent contrast ratio and color reproduction characteristics.

BRIEF SUMMARY

In a display device, sub-pixel rendering has been developed in various ways according to application fields. A data driving circuit is designed according to a sub-pixel rendering. The data driving circuit may be developed to be optimized for a particular sub-pixel arrangement structure. In this case, the data driving circuit is incompatible with models having different sub-pixel arrangement structures, and thus it is difficult to share components.

A common gamma compensation voltage may be applied to the data driving circuit. In this case, image quality may be degraded in some colors of a reproduced image.

One or more embodiments of the present disclosure addresses the above-mentioned needs and/or problems. The present disclosure is directed to providing a data driving circuit applicable to various sub-pixel arrangements without degrading image quality, and a display device using the same.

It should be noted that the technical benefits of the present disclosure are not limited to the above-described benefits, and other benefits of the present disclosure will be apparent to those skilled in the art from the following descriptions.

According to an aspect of the present disclosure, there is provided a data driving circuit including a first voltage divider circuit configured to output a gamma compensation voltage for a first color, a second voltage divider circuit configured to output a gamma compensation voltage for a second color, a third voltage divider circuit configured to output a gamma compensation voltage for a third color, a first digital-to-analog converter (DAC) connected to the first voltage divider circuit and configured to convert input data for the first color using the gamma compensation voltage for the first color to output a data voltage of a first channel, a second DAC connected to the second voltage divider circuit and configured to convert input data for the second color using the gamma compensation voltage for the second color to output a data voltage for a second channel, and a third DAC connected to the third voltage divider circuit and configured to convert input data for the third color using the gamma compensation voltage for the third color to output a data voltage of a third channel.

Some of the channels may be connected to data lines of a display panel through a multiplexer, and at least one of the channels may be directly connected to a corresponding data line of the display panel.

A display device of the present disclosure includes a display panel driven by the data driving circuit.

BRIEF DESCRIPTION OF THE DRAWINGS

The above and other features, and advantages of the present disclosure will become more apparent to those of ordinary skill in the art by describing example embodiments thereof in detail with reference to the accompanying drawings, in which.

DETAILED DESCRIPTION

Figure 1:
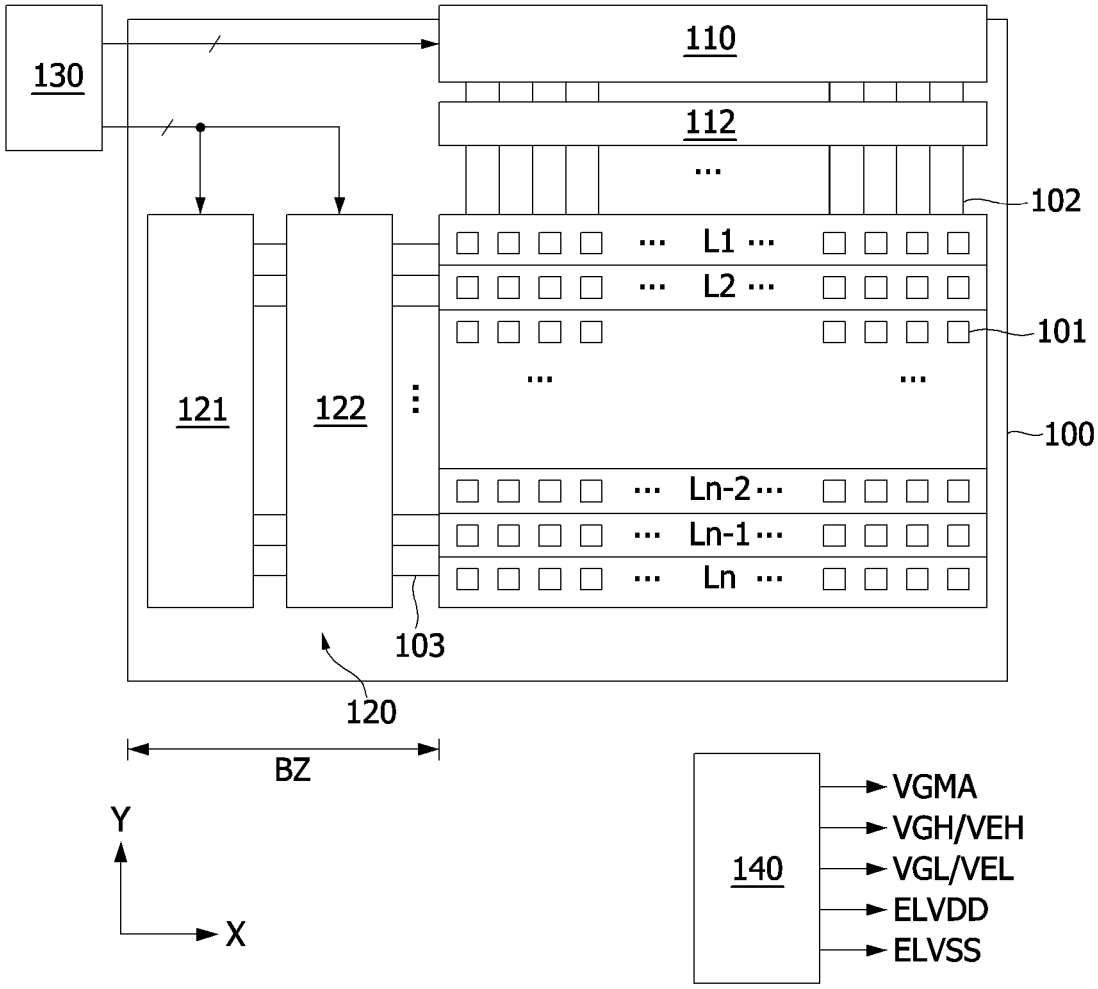
FIG. 1 is a block diagram illustrating a display device according to an embodiment of the present disclosure.

Advantages and features of the present disclosure, and implementation methods thereof will be clarified through the following embodiments described with reference to the accompanying drawings. However, the present disclosure is not limited to embodiments disclosed herein and may be implemented in various different forms. The embodiments are provided for making the disclosure of the present disclosure thorough and for fully conveying the scope of the present disclosure to those skilled in the art.

The figures, dimensions, ratios, angles, numbers, and the like disclosed in the drawings for describing the embodiments of the present disclosure are merely illustrative and are not limited to matters shown in the present disclosure. Like reference numerals refer to like elements throughout. Further, in describing the present disclosure, detailed descriptions of well-known technologies will be omitted when it is determined that they may unnecessarily obscure the gist of the present disclosure.

Terms such as "including" and "having" used herein are intended to allow other elements to be added unless the terms are used with the term "only." Any references to singular may include plural unless expressly stated otherwise.

Components are interpreted to include an ordinary error range even if not expressly stated.

For description of a positional relationship, for example, when the positional relationship between two parts is described as "on," "above," "below," "next to," and the like, one or more parts may be interposed therebetween unless the term "immediately" or "directly" is used in the expression.

While terms, such as "first," "second," etc., may be used to describe various components, such components must not be limited by the above terms. The above terms are used only to distinguish one component from another.

For description of a temporal relationship, for example, when a temporal relationship is described as "after," "subsequently to," "next," "before," and the like, a non-consecutive case may be included unless the term "immediately" or "directly" is used in the expression.

The features of various embodiments of the present disclosure may be partially or entirely bonded to or combined with each other. The embodiments may be interoperated and performed in technically various ways and may be carried out independently of or in association with each other.

Each of the pixels may include a plurality of sub-pixels having different colors for color implementation, and each of the sub-pixels may include a transistor used as a switch element or a driving element. Such a transistor may be implemented as a Thin Film Transistor (TFT).

The driving circuit of the display device writes pixel data of an input image to the pixels. The driving circuit may include a data driver that supplies a data signal to the data lines, and a gate driver that supplies a gate signal to the gate lines.

Each of the pixel circuit and the gate driver may include a plurality of transistors and may be directly formed on the substrate of the display panel.

The transistors may be implemented as oxide thin film transistors (TFTs) including oxide semiconductors, low temperature poly silicon (LTPS) TFTs including LTPSs, and the like. Each of the transistors may be implemented as a p-channel TFT or an n-channel TFT. In the embodiment, the transistors of a pixel circuit are mainly described as an example implemented as p-channel TFTs, but the present disclosure is not limited thereto.

The transistor is a three-electrode element including a gate, a source, and a drain. The source is an electrode for supplying a carrier to the transistor. In the transistor, the carries begins to flow from the source. The drain is an electrode in which the carrier is discharged from the transistor to the outside. In the transistor, the carrier flows from the source to the drain. In the case of an n-channel transistor, since the carrier is an electron, a source voltage is lower than a drain voltage so as to allow electrons to flow from the source to the drain. In the n-channel transistor, a current flows in a direction from the drain to the source. In the case of a p-channel transistor (a p-type metal oxide semiconductor (PMOS)), since the carrier is a hole, the source voltage is higher than the drain voltage so as to allow holes to flow from the source to the drain. In the p-channel transistor, since the holes flow from the source to the drain, a current flows from the source to the drain. It should be noted that the source and the drain of the transistor are not fixed. For example, the source and the drain may be changed according to an applied voltage. Therefore, the present disclosure is not limited due to the source and the drain of the transistor. In the following description, the source and the drain of the transistor will be referred to as a first electrode and a second electrode, respectively.

A gate signal swings between a gate on voltage and a gate off voltage. The gate on voltage is set to a voltage that is higher than a threshold voltage of the transistor, and the gate off voltage is set to a voltage that is lower than the threshold voltage of the transistor. The transistor is turned on in response to the gate on voltage, whereas the transistor is turned off in response to the gate off voltage. In the case of the n-channel transistor, the gate on voltage may be a gate high voltage (VGH, VEH), and the gate off voltage may be a gate low voltage (VGL, VEL). In the case of the p-channel transistor, the gate on voltage may be the VGL and VEL, and the gate off voltage may be the VGH and VEH.

In the following embodiments, it should be noted that although the example in which the transistors of the pixel circuit are implemented as p-channel transistors is described, the present disclosure is not limited thereto.

Hereinafter, various embodiments of the present disclosure will be described in detail with reference to the accompanying drawings. In the following embodiments, a display device is mainly described as being an organic light-emitting display device, but the present disclosure is not limited thereto.

Referring to FIGS. 1 to 4, a display device according to an embodiment of the present disclosure includes a display panel 100, a display panel driving circuit (which may be referred to herein as a display panel driving unit) configured to write pixel data to pixels of the display panel 100, and a power supply circuit 140 (which may be referred to herein as a power supply unit 140) configured to generate power required for driving the pixels and the display panel driving unit.

The display panel driving unit may include any electrical circuitry, features, components, an assembly of electronic components or the like configured to perform the various operations of the display panel driving features as described herein. In some embodiments, the display panel driving unit may be included in or otherwise implemented by processing circuitry such as a microprocessor, microcontroller, integrated circuit, chip, microchip or the like. Similarly, the power supply unit may include any electrical circuitry, features, components, an assembly of electronic components or the like configured to perform the various operations of the power supplying features as described herein. In some embodiments, the power supply unit may be included in or otherwise implemented by processing circuitry such as a microprocessor, microcontroller, integrated circuit, chip, The display panel 100 includes a pixel array configured to display an input image on a screen. The pixel array includes a plurality of data lines 102, a plurality of gate lines 103 overlapping the data lines 102, and pixels arranged in a matrix form. The display panel 100 may further include power lines connected to the pixels in common.

The pixel array includes a plurality of pixel lines L1 to Ln. Each of the pixel lines L1 to Ln includes one line of pixels arranged along a line direction X in the pixel array of the display panel 100. The pixels arranged in one pixel line share the gate lines 103. Sub-pixels arranged in a column direction Y along a data line direction share the same data line 102. One horizontal period 1H is a period obtained by dividing one frame period by the total number of pixel lines L1 to Ln.

The display panel 100 may be implemented as a non-transmissive display panel or a transmissive display panel. The transmissive display panel is applicable to a transparent display device in which an image is displayed on a screen and a real background object is visible.

The display panel may be manufactured as a flexible display panel. The flexible display panel may be implemented as an organic light-emitting diode (OLED) panel using a plastic substrate. A plastic OLED panel may include a pixel array and a light-emitting element that are disposed on an organic thin film adhered to a back plate.

The back plate of the plastic OLED panel may be a polyethylene terephthalate (PET) substrate. The organic thin film is disposed on the back plate. A pixel circuit and the light-emitting element may be stacked on the organic thin film, and a touch sensor array may be formed thereon. The back plate blocks permeation of moisture to the organic thin film so that the pixel array is not exposed to moisture. The organic thin film may be a thin polyimide (PI) film substrate. A multilayer buffer film made of an insulating material (not shown) may be formed on the organic thin film. Lines of the pixel array for supplying power or signals, which are applied to the pixel array and the touch sensor array, may be formed on the organic thin film.

Each of pixels 101 may be divided into a red sub-pixel, a green sub-pixel, and a blue sub-pixel for color implementation. Each of the pixels may further include a white sub-pixel. Each of the sub-pixels includes a pixel circuit. Hereinafter, a pixel may be considered synonymous with a sub-pixel. Hereinafter, a first color refers to any one of red, green, and blue colors, and second and third colors refer to two colors except for the first color.

Figure 2:
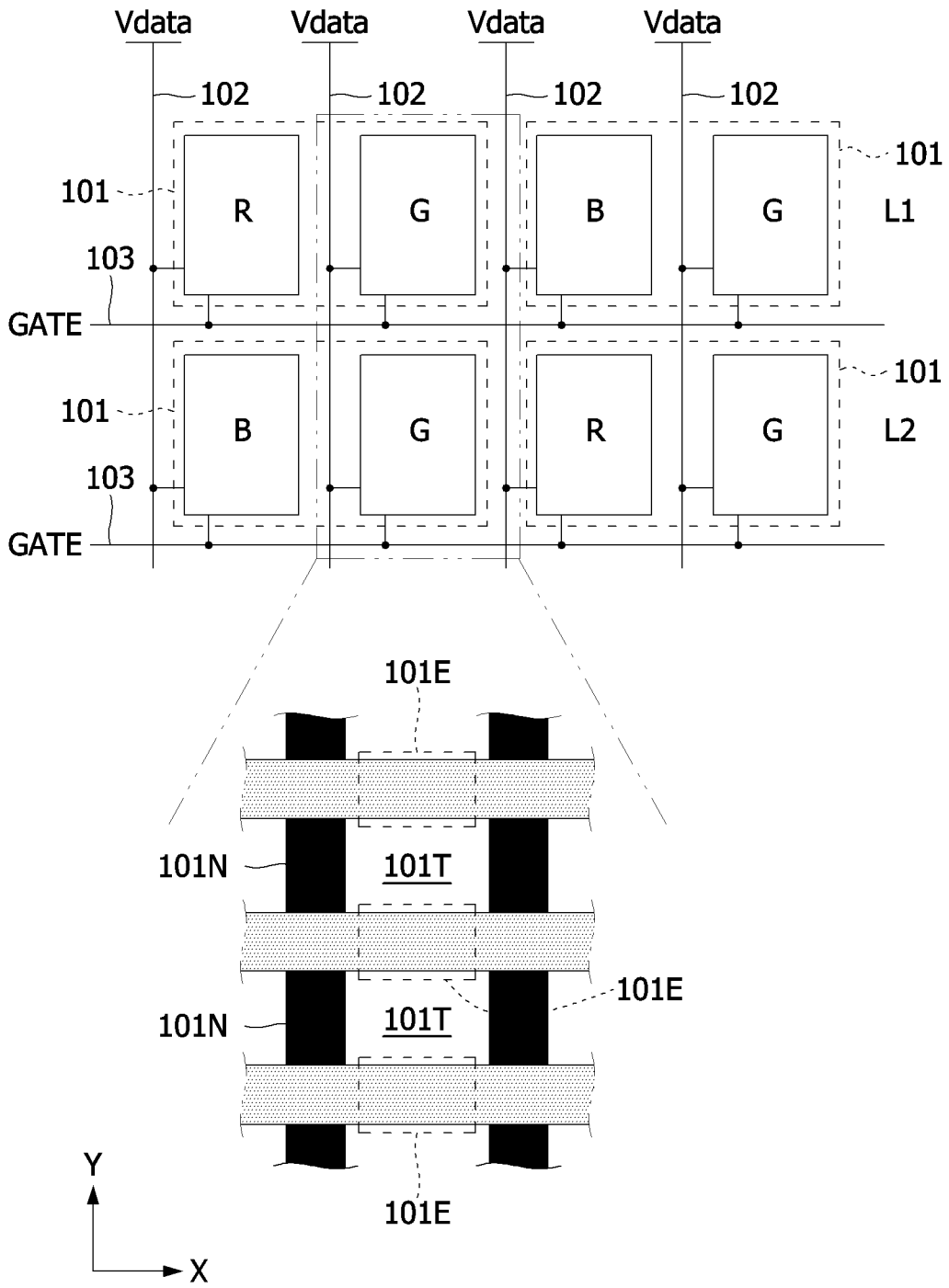
FIGS. 2 to 4 are diagrams illustrating cases in which sub-pixel rendering is variously performed.

As shown in FIG. 2, in a transparent display device, each of the sub-pixels may include a transmission portion 101T, a light-emitting portion 101E, and a non-transmission and non-light-emitting portion 101N. The transmission portion 101T is a portion in which an element that prevents light transmission such as an emission layer, a color filter, a pixel circuit, and the like of a light-emitting element, is reduced or minimized. The transmission portion 101T is a transparent portion in which a real background object including a real object outside the display panel 100 appears as it is. Signal lines may be disposed in the transmission portion 101T. In this case, the signal lines may be formed of a transparent signal line in order to reduce the decrease in transmittance of the transmission portion 101T. In order to prevent the transmittance of the transmission portion 101T from being reduced due to the signal lines, the signal lines may not be disposed in the transmission portion 101T. Accordingly, in some embodiments, the signal lines may be formed as patterns that bypass the transmission portion 101T. The signal lines may include the data line 102, the gate line 103, the power line, and the like.

The light-emitting portion 101E is a portion that includes the emission layer of the light-emitting element and emits light corresponding to a grayscale of pixel data. The emission layer may be an emission layer EML of an OLED. The light-emitting portion 101E may overlap horizontal lines of the pixel array. The horizontal lines may include the gate line 103. The light-emitting portion 101E may include a color filter. The light-emitting portion 101E may include a transmission portion through which light is transmitted, but the transmittance of the light-emitting portion 101E is lower than that of the transmission portion 101T.

The non-transmission and non-light-emitting portion 101N is a portion covered by a black matrix BM and in which the emission layer of the light-emitting element EL is not present. The non-transmission and non-light-emitting portion 101N may include vertical lines. The vertical line may include the data line 102 and the power line. The power line may be one or more of an ELVDD line, a Vref line, and a Vini line.

Figure 3:
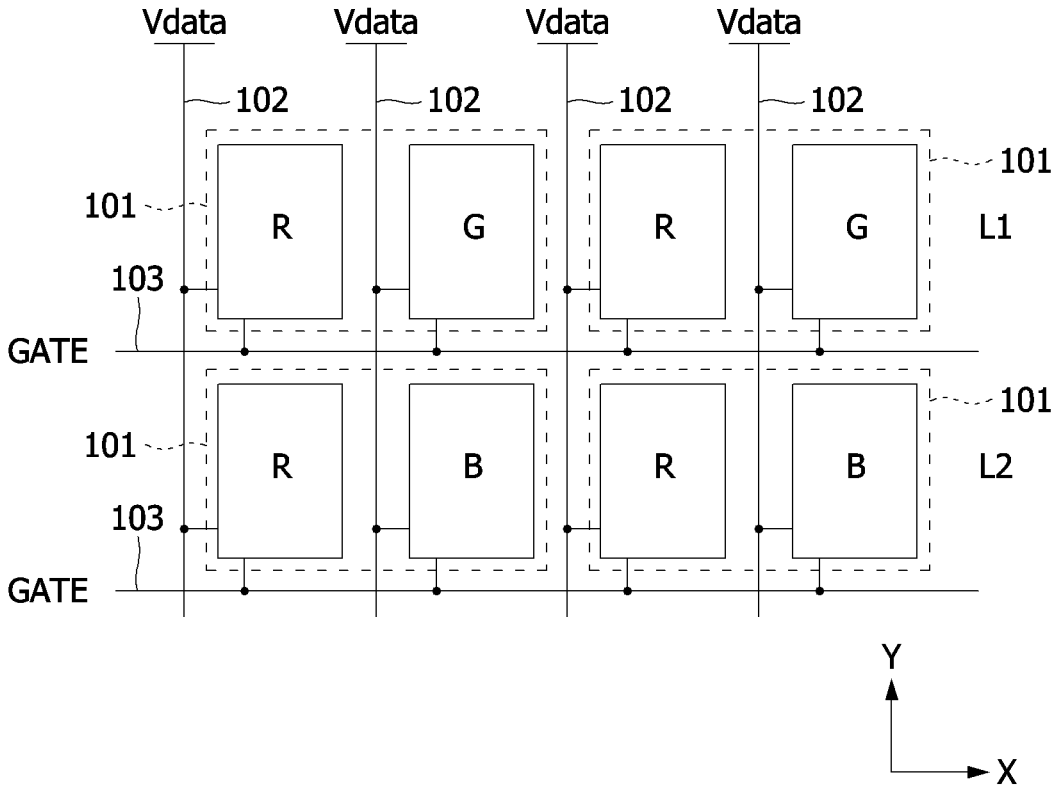
Figure 4:
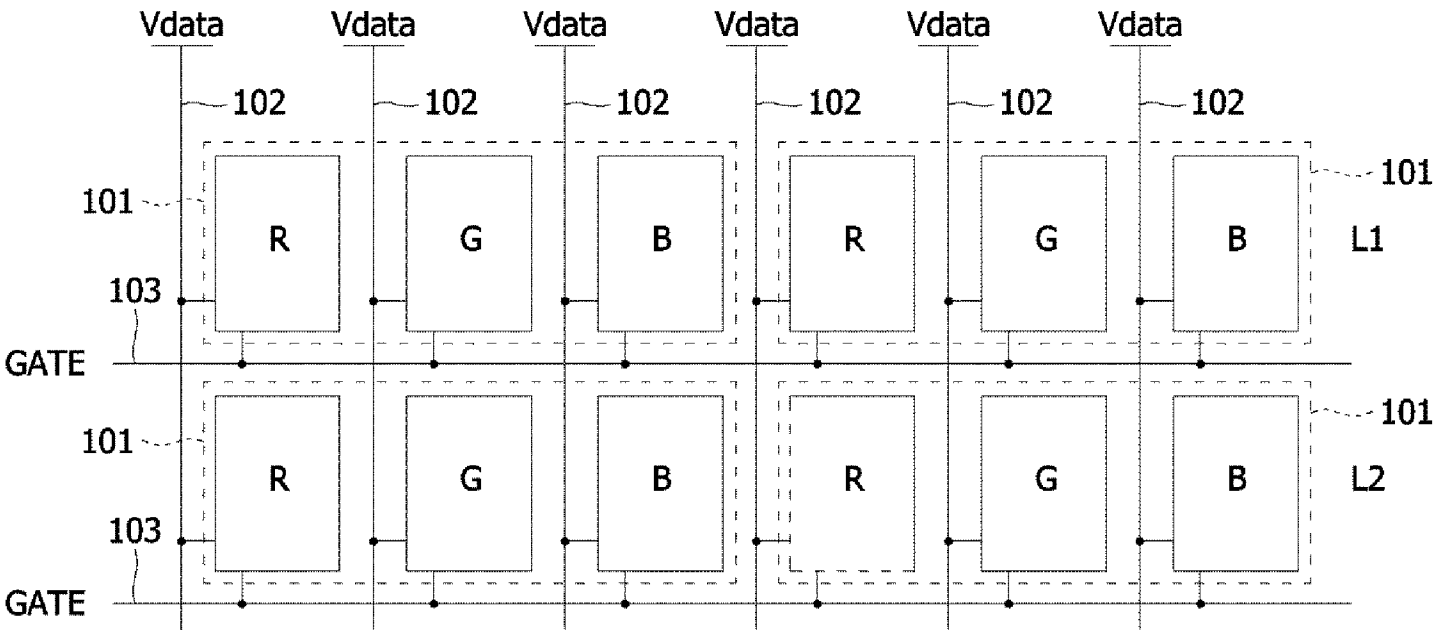

The pixels may be arranged as real color pixels or pentile pixels. The pentile pixels may implement a higher resolution than the real color pixels by driving two sub-pixels with different colors as one pixel 101, as shown in FIGS. 2 and 3, by using a preset pentile pixel rendering algorithm. The pentile pixel rendering algorithm may compensate for the lack of color representations in each of the pixels with the color of light emitted from an adjacent pixel. In the case of the real color pixels, one pixel 101 includes sub-pixels of first to third colors, as shown in FIG. 4. In FIGS. 2 to 4, "Vdata" is a data voltage applied to the data lines 102, and "GATE" is a gate signal applied to the gate lines 103.

Touch sensors may be arranged on the display panel 100. A touch input may be sensed using separate touch sensors or through the pixels. The touch sensors may be implemented as on-cell type or add-on type touch sensors, which are arranged on a screen of the display panel, or may be implemented as in-cell type touch sensors, which are embedded in the pixel array.

The power supply unit 140 generates direct current (DC) power necessary to drive the display panel driving unit and the pixel array of the display panel 100 using a DC-DC converter. The DC-DC converter may include a charge pump, a regulator, a buck converter, a boost converter, and the like. The power supply unit 140 may generate DC voltages such as a gamma reference voltage VGMA, gate-on voltages VGL and VEL, gate-off voltages VGH and VEH, a pixel driving voltage ELVDD, a low-potential power supply voltage ELVSS, and reference/initialization voltages Vref and Vini by adjusting a level of a DC input voltage received from a host system (not shown). The gamma reference voltage VGMA is supplied to a data driving unit 110. The gate-on voltages VGL and VEL and the gate-off voltages VGH and VEH are supplied to a gate driving unit 120. The pixel driving voltage ELVDD, the low-potential power supply voltage ELVSS, and the reference/initialization voltages Vref and Vini may be supplied in common to the pixels.

The display panel driving unit writes pixel data of an input image to the pixels of the display panel 100 under the control of a timing controller (TCON) 130.

The display panel driving unit includes the data driving unit 110 and the gate driving unit 120. The display panel driving unit may further include a multiplexer array 112 disposed between the data driving unit 110 and the data lines 102.

The multiplexer array 112 sequentially connects data voltages output from channels of the data driving unit 110 to the data lines 102 using a plurality of multiplexers (MUX). The multiplexer array 112 may include a plurality of switch elements disposed on the display panel 100.

The display panel driving unit may further include a touch sensor driving unit for driving the touch sensors. The touch sensor driving unit is omitted from FIG. 1. The data driving unit and the touch sensor driving unit may be integrated into one integrated circuit (IC). In a mobile device or a wearable device, the timing controller 130, the power supply unit 140, and the data driving unit 110 may be integrated into a single driver IC.

The display panel driving unit may operate in a low-speed driving mode under the control of the timing controller 130. The low-speed driving mode may be set to reduce power consumption of the display device when an input image has not changed as much as the preset number of frames by analyzing the input image. In the low-speed driving mode, by lowering a refresh rate of pixels when a still image is input for a certain time or more, it is possible to reduce power consumption of the display panel 100 and the display panel driving unit. The low-speed driving mode is not limited to when a still image is input. For example, when the display device operates in a standby mode or when a user command or an input image is not input to the display panel driving unit for a predetermined period or more, the display panel driving unit may operate in the low-speed driving mode.

The data driving unit 110 converts pixel data of an input image, which is received as a digital signal from the timing controller 130 for every frame period, using a gamma compensation voltage using a digital-to-analog converter (DAC) and outputs a data voltage. The gamma reference voltage VGMA is divided into a gamma compensation voltage for each grayscale through a voltage divider circuit. The gamma compensation voltage for each grayscale is provided to the DAC of the data driving unit 110. The data voltage is output through an output buffer in each of the channels of the data driving unit 110.

The gate driving unit 120 may be implemented as a gate-in-panel (GIP) circuit that is directly formed on the display panel 100 together with a thin film transistor (TFT) array and lines of the pixel array. The GIP circuit may be disposed on a bezel area BZ, which is a non-display area of the display panel 100, or may be disposed by being distributed in the pixel array in which an input image is reproduced. The gate driving unit 120 sequentially outputs the gate signal to the gate lines 103 under the control of the timing controller 130. The gate driving unit 120 may shift the gate signal using a shift register to sequentially supply the resultant signals to the gate lines 103. The gate signal may include a scan signal and an emission control signal (hereinafter, referred to as an "EM signal") in the organic light-emitting display device. The scan signal includes a scan pulse that swings between the gate-on voltage VGL and the gate-off voltage VGH. The EM signal may include an EM pulse that swings between the gate-on voltage VEL and the gate-off voltage VEH.

The scan pulse is synchronized to the data voltage to select the pixels of the line to which data is to be written. The EM signal defines an emission time of the pixels.

The gate driving unit 120 may include a first gate driving unit 121 and a second gate driving unit 122. The first gate driving unit 121 outputs the scan pulse in response to a start pulse and a shift clock received from the timing controller 130 and shifts the scan pulse according to a shift clock timing. The second gate driving unit 122 outputs the EM pulse in response to the start pulse and the shift clock received from the timing controller 130 and sequentially shifts the EM pulse according to the shift clock.

The timing controller 130 receives digital video data DATA of the input image and a timing signal synchronized with the digital video data from the host system. The timing signal may include a vertical synchronization signal Vsync, a horizontal synchronization signal Hsync, a clock CLK, a data enable signal DE, and the like. Since a vertical period and a horizontal period may be obtained through a method of counting the data enable signal DE, the vertical synchronization signal Vsync and the horizontal synchronization signal Hsync may be omitted. The data enable signal DE has a period of one horizontal period 1H.

The host system may be one of a television system, a set-top box, a navigation system, a personal computer (PC), a home theater system, a mobile device, a wearable device, and a vehicle system.

The timing controller 130 may multiply an input frame frequency by i (here, i is an integer greater than zero) to control the operation timing of the display panel driving unit at a frame frequency of the input frame frequency×i Hz. The input frame frequency is 60 Hz for National Television Standards Committee (NTSC) and 50 Hz for Phase-Alternating Line (PAL). The timing controller 130 may lower a driving frequency of the display panel driving unit by lowering the frame frequency to a frequency between 1 Hz and 30 Hz in order to lower the refresh rate of the pixels in the low-speed driving mode.

The timing controller 130 may generate a data timing control signal for controlling the operation timing of the data driving unit 110, MUX signals MUX1 and MUX2 for controlling the operation timing of the multiplexer array 112, and a gate timing control signal for controlling the operation timing of the gate driving unit 120 on the basis of the timing signals Vsync, Hsync, and DE received from the host system. The timing controller 130 synchronizes the data driving unit 110, the multiplexer array 112, the touch sensor driving unit, and the gate driving unit 120 by controlling the operation timing of the display panel driving unit.

A voltage level of the gate timing control signal output from the timing controller 130 may be converted into the gate-on voltages VGL and VEL and the gate-off voltages VGH and VEH through a level shifter (not shown) and supplied to the gate driving unit 120. The level shifter converts a low-level voltage of the gate timing control signal into a gate low voltage VGL and converts a high-level voltage of the gate timing control signal into a gate high voltage VGH. The gate timing control signal includes the start pulse and the shift clock.

Demultiplexers (DEMUXs) may be connected between the data driving unit and the data lines. The demultiplexer may reduce the number of channels of the data driving unit 110 by time-divisionally distributing the data voltage output from one channel of the data driving unit 110 to the data lines 102. In the present disclosure, the data lines of the pixel array are connected to the data driving unit through the multiplexers without using the demultiplexer in order to share the components of the data driving unit and secure the charging time of the pixels without degrading the image quality.

Figure 5:
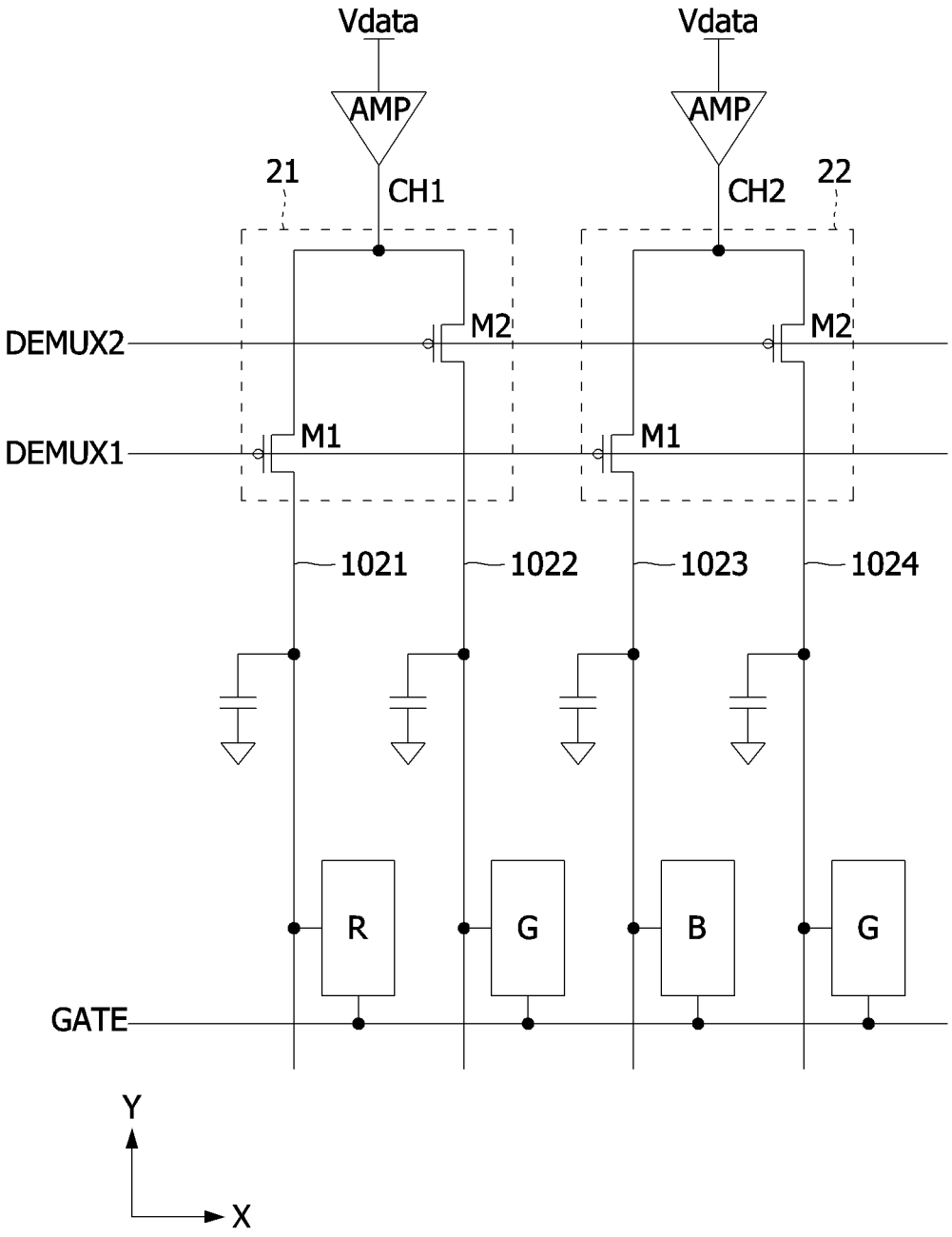
FIG. 5 is a circuit diagram illustrating switch elements of a demultiplexer.

FIG. 5 is a circuit diagram illustrating switch elements of the demultiplexer.

Referring to FIG. 5, demultiplexers 21 and 22 may be a 1:N demultiplexer having one input node and N (N is a positive integer greater than or equal to 2) output nodes. Each of the demultiplexers 21 and 22 may include first and second switch elements M1 and M2.

The first switch element M1 is turned on in response to a gate-on voltage VGL of a first DEMUX signal DEMUX1. In this case, a first channel CH1 of the data driving unit 110 outputs a data voltage Vdata through an output buffer AMP and the data voltage Vdata is applied to a first data line 1021 through the first switch element M1. At the same time, a second channel CH2 of the data driving unit 110 outputs a data voltage Vdata through an output buffer AMP, and the data voltage Vdata is applied to a third data line 1023 through the first switch element M1. Thus, the data voltage Vdata is charged in a capacitor of each of the first and third data lines 1021 and 1023 during a half horizontal period.

Subsequently, the second switch element M2 is turned on in response to a gate-on voltage VGL of a second DEMUX signal DEMUX2. In this case, the first channel CH1 of the data driving unit 110 outputs the data voltage Vdata through the output buffer AMP and the data voltage Vdata is applied to a second data line 1022 through the second switch element M2. At the same time, the second channel CH2 of the data driving unit 110 outputs the data voltage Vdata through the output buffer AMP, and the data voltage Vdata is applied to a fourth data line 1024 through the second switch element M2. Thus, a capacitor of each of the second and fourth data lines 1022 and 1024 is charged with the data voltage during a half horizontal period.

Figure 6:
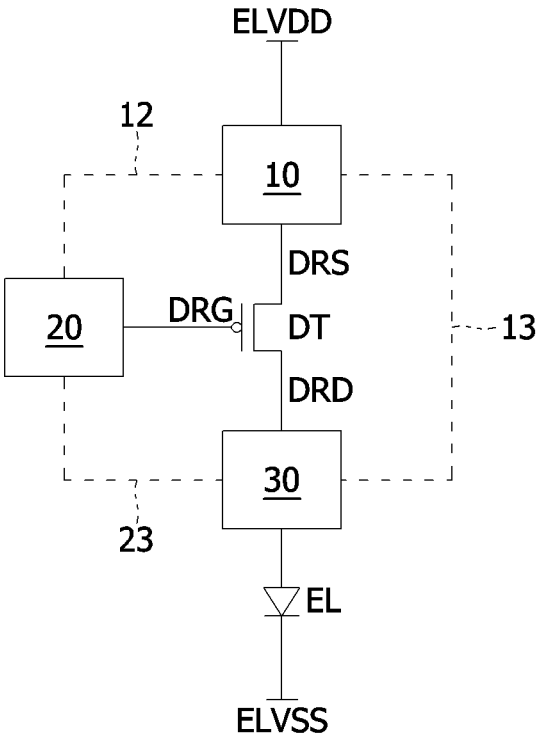
FIG. 6 is a schematic diagram illustrating a pixel circuit of the present disclosure.

FIG. 6 is a schematic diagram illustrating a pixel circuit of the present disclosure.

Referring to FIG. 6, the pixel circuit includes a light-emitting element EL, a driving element DT, and circuit units 10, 20, and 30. Each of switch elements of each of the driving element DT and the circuit units 10, 20, and 30 may be implemented as a transistor. The transistors of the pixel circuit may each be implemented as a p-channel TFT, but the present disclosure is not limited thereto.

A first circuit unit 10 supplies the pixel driving voltage ELVDD to the driving element DT. The driving element DT includes a gate DRG, a source DRS, and a drain DRD. A second circuit unit 20 charges a capacitor connected to the gate DRG of the driving element DT and maintains a voltage of the capacitor during one frame period. A third circuit unit 30 provides current supplied from the pixel driving voltage ELVDD through the driving element DT to the light-emitting element EL. A first connection unit 12 connects the first circuit unit 10 and the second circuit unit 20. A second connection unit 23 connects the second circuit unit 20 and the third circuit unit 30. A third connection unit 13 connects the third circuit unit 30 and the first circuit unit 10.

The circuit units 10, 20, and 30 may each include an internal compensation circuit configured to sense a threshold voltage Vth of the driving element DT and compensate the data voltage Vdata by the threshold voltage Vth.

Figure 7:
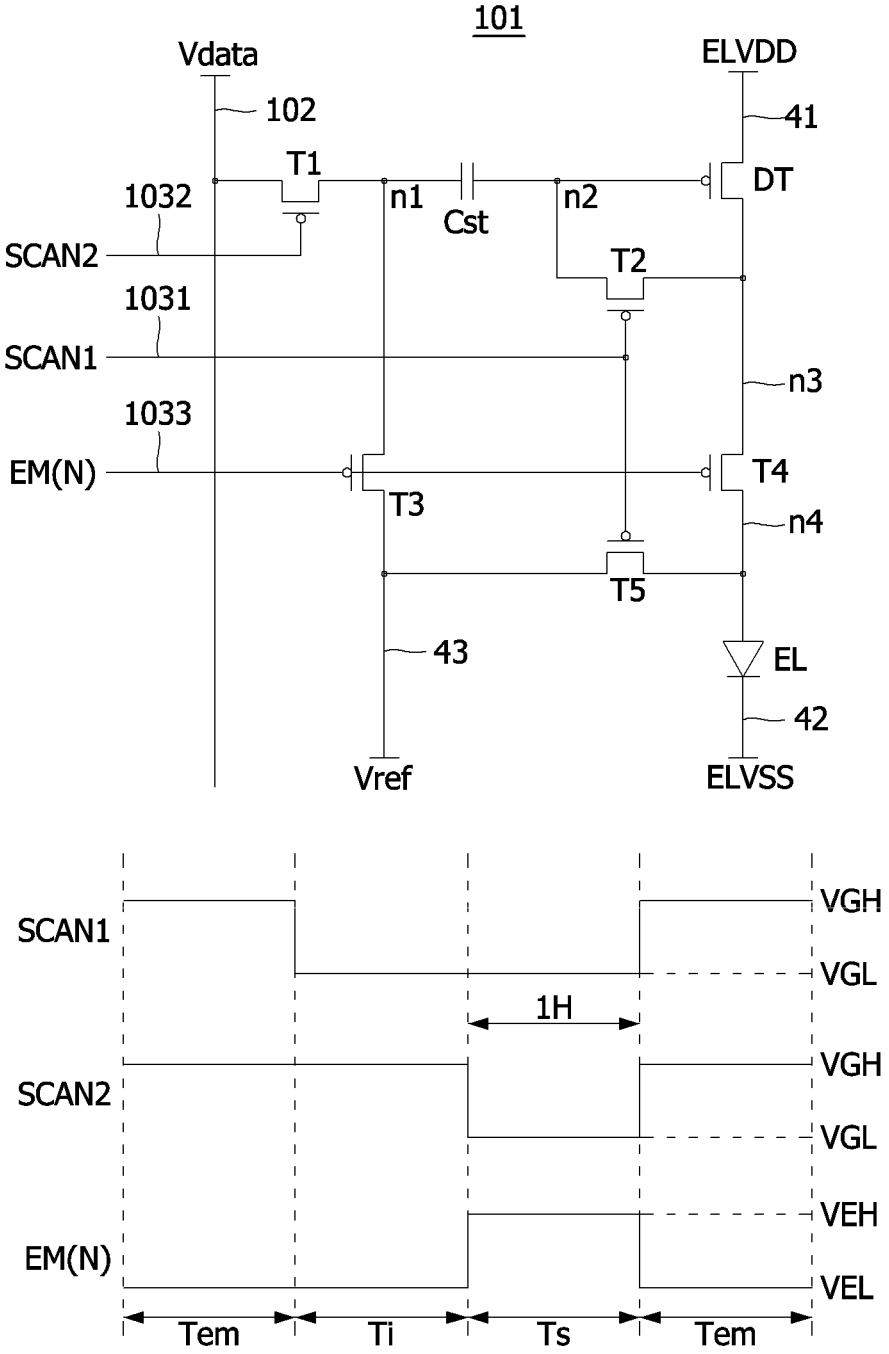
FIGS. 7 and 8 are circuit diagrams illustrating pixel circuits applicable to a display device according to an embodiment of the present disclosure in detail.
Figure 8:
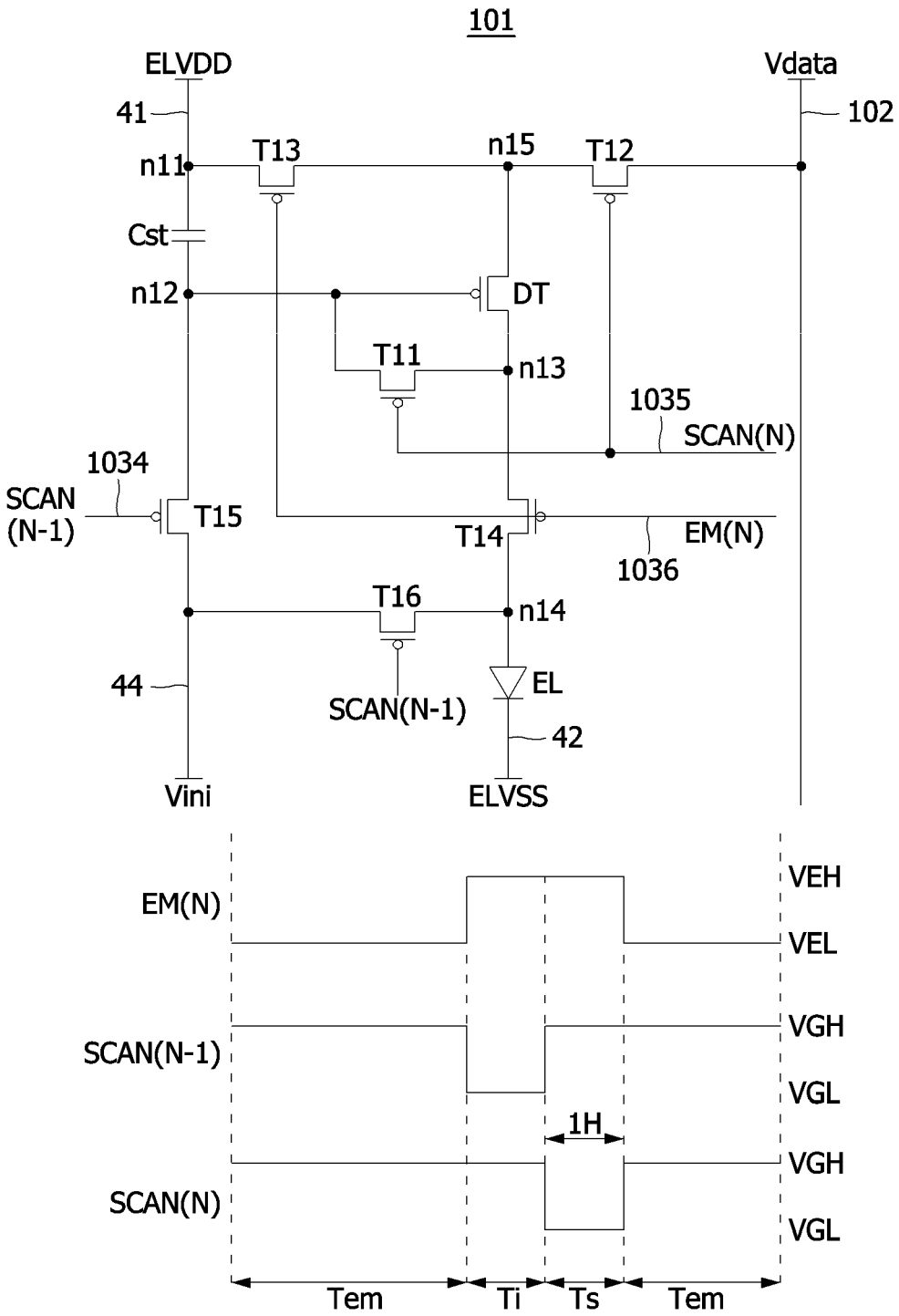

FIGS. 7 and 8 are circuit diagrams illustrating pixel circuits applicable to the present disclosure in detail.

The display panel 100 may include a first power line 41 for supplying the pixel driving voltage ELVDD to pixels P, a second power line 42 for supplying the low-potential power supply voltage ELVSS to the pixels 101, and third power lines 43 and 44 for supplying the reference/initialization voltages Vref and Vini, which are used for initializing the pixel circuit, to the pixels P. The DC voltage output from the power supply unit 140 is applied in common to the pixels 101 through the power lines.

In FIGS. 7 and 8, the light-emitting element EL may be implemented as an OLED. The OLED includes an organic compound layer formed between an anode and a cathode. The organic compound layer may include a hole injection layer HIL, a hole transport layer HTL, an emission layer EML, an electron transport layer ETL, and an electron injection layer EIL. When a voltage is applied to the anode and the cathode of the OLED, holes passing through the hole transport layer HTL and electrons passing through the electron transport layer ETL move to the emission layer EML to create excitons and thus, visible light is emitted from the emission layer EML.

Referring to FIG. 7, the anode of the light-emitting element EL is connected to fourth and fifth switch elements T4 and T5 through a fourth node n4. The cathode of the light-emitting element EL is connected to the second power line 42 through which the low-potential power supply voltage ELVSS is applied. The driving element DT controls the amount of current flowing through the light-emitting element EL according to a gate-source voltage Vgs thereof to drive the light-emitting element EL. The current flowing through the light-emitting element EL may be switched by the fourth switch element T4. A capacitor Cst is connected between a first node n1 and a second node n2.

A first switch element T1 supplies the data voltage Vdata to the first node n1 in response to a second scan signal SCAN2. The first switch element T1 includes a gate connected to a second gate line 1032, a first electrode connected to the data line 102, and a second electrode connected to the first node n1.

The second scan signal SCAN2 is supplied to the pixels P through the second gate line 1032. The second scan signal SCAN2 is generated as a pulse of the gate-on voltage VGL. The pulse of the second scan signal SCAN2 defines a sensing operation Ts. A pulse width of the second scan signal SCAN2 may be set to approximately one horizontal period 1H. The second scan signal SCAN2 is inverted to the gate-on voltage VGL later than a first scan signal SCAN1 and inverted to the gate-off voltage VGH at the same time as the first scan signal SCAN1. Here, the pulse width of the second scan signal SCAN2 is set to be smaller than that of the first scan signal SCAN1. During an initialization operation Ti and an emission operation Tem, a voltage of the second scan signal SCAN2 is maintained at the gate-off voltage VGH.

A second switch element T2 connects a gate of the driving element DT and a second electrode of the driving element DT in response to the first scan signal SCAN1 so that the driving element DT operates as a diode. The second switch element T2 includes a gate connected to a first gate line 1031, a first electrode connected to the second node n2, and a second electrode connected to a third node n3.

The first scan signal SCAN1 is supplied to the pixels P through the first gate line 1031. The first scan signal SCAN1 may be generated as a pulse of the gate-on voltage VGL. The pulse of the first scan signal SCAN1 defines the initialization operation Ti and the sensing operation Ts. During the emission operation Tem, a voltage of the first scan signal SCAN1 is maintained at the gate-off voltage VGH.

A third switch element T3 supplies a predetermined reference voltage Vref to the first node n1 in response to an EM signal EM(N). The reference voltage Vref is supplied to the pixels P through the third power line 43. The third switch element T3 includes a gate connected to a third gate line 1033, a first electrode connected to the first node n1, and a second electrode connected to the third power line 43. The EM signal EM(N) defines an on/off time of the light-emitting element EL.

A pulse of the EM signal EM(N) may be generated as the gate-off voltage VEH in order to block a current path between the first node n1 and the third power line 43 during the sensing operation Ts and block a current path of the light-emitting element EL. When the second scan signal SCAN2 is inverted to the gate-on voltage VGL, the EM signal EM(N) may be inverted to the gate-off voltage VEH, and after the first and second scan signals SCAN1 and SCAN2 are inverted to the gate-off voltage VGH, the EM signal EM(N) may be inverted to the gate-on voltage VEL. In order to precisely express low-grayscale luminance, the EM signal EM(N) may swing between the gate-on voltage VEL and the gate-off voltage VEH at a predetermined duty ratio during the emission operation Tem.

The fourth switch element T4 switches the current path of the light-emitting element EL in response to the EM signal EM(N). A gate of the fourth switch element T4 is connected to the third gate line 1033. A first electrode of the fourth switch element T4 is connected to the third node n3, and a second electrode of the fourth switch element T4 is connected to the fourth node n4.

The fifth switch element T5 is turned on according to the gate-on voltage VGL of the first scan signal SCAN1 to supply the reference voltage Vref to the fourth node n4 during the initialization operation Ti and the sensing operation Ts. During the initialization operation Ti and the sensing operation Ts, an anode voltage of the light-emitting element EL is discharged to the reference voltage Vref. In this case, since the voltage between the anode and the cathode of the light-emitting element EL is less than a threshold voltage of the light-emitting element EL, the light-emitting element EL does not emit light. The fifth switch element T5 includes a gate connected to the first gate line 1031, a first electrode connected to the third power line 43, and a second electrode connected to the fourth node n4.

The driving element DT controls current flowing through the light-emitting element EL according to the gate-source voltage Vgs thereof to drive the light-emitting element EL. The driving element DT includes the gate connected to the second node n2, the first electrode connected to the first power line 41, and the second electrode connected to the third node n3. The pixel driving voltage ELVDD is supplied to the pixels P through the first power line 41.

The pixel circuit shown in FIG. 7 includes an internal compensation circuit. An operation of the internal compensation circuit may be divided into an initialization operation Ti, a sensing operation Ts, an emission operation Tem.

In the initialization operation Ti, a voltage of each of the first scan signal SCAN1 and the EM signal EM(N) is the gate-on voltage VGL. In the initialization operation Ti, the second to fifth switch elements T2 to T5 are turned on to discharge a voltage of each of the first node n1, the second node n2, and the fourth node n4 to the reference voltage Vref. As a result, in the initialization operation Ti, the capacitor Cst, a gate voltage of the driving element DT, and an anode voltage of the light-emitting element EL are initialized to the reference voltage Vref.

In the sensing operation Ts, the first, second, and fifth switch elements T1, T2, and T5 are turned on according to the gate-on voltage VGL of each of the scan signals SCAN1 and SCAN2. At this point, the data voltage Vdata is applied to the first node n1, and the voltage of the second node n2 is changed to ELVDD+Vth. As a result, a threshold voltage Vth of the driving element DT is sensed in the sensing operation Ts and is charged to the second node n2. During the sensing operation Ts, the data voltage Vdata compensated for by the threshold voltage Vth of the driving element DT is charged in the capacitor Cst.

In the emission operation Tem, the voltage of the EM signal EM(N) is inverted to the gate-on voltage VGL. The third and fourth switch elements T3 and T4 are turned on in the emission operation Tem. At this point, the voltage of the first node n1 changes to the reference voltage Vref, and the voltage of the second node n2 changes to Vref-Vdata+ELVDD+Vth. In the emission operation Tem, the light-emitting element EL is driven by the current provided through the driving element DT to emit light. The current flowing through the light-emitting element EL is adjusted according to a gate-source voltage Vgs of the driving element DT. During the emission operation Tem, the gate-source voltage Vgs of the driving element DT is equal to Vref-Vdata+Vth.

Referring to FIG. 8, the gate signal applied to this pixel circuit includes an N−1th scan signal SCAN(N−1), an Nth scan signal SCAN(N), and an EM signal EM(N). The N−1th scan signal SCAN(N−1) is synchronized with a data voltage Vdata of an N−1th pixel line. The Nth scan signal SCAN(N) is synchronized with a data voltage Vdata of an Nth pixel line. A pulse of the Nth scan signal SCAN(N) is generated with the same pulse width as the N−1th scan signal SCAN (N−1) and is generated later than a pulse of the N−1th scan signal SCAN(N−1).

A capacitor Cst is connected between a first node n11 and a second node n12. The pixel driving voltage ELVDD is supplied to the pixel circuit through a first power line 41. The first node n11 is connected to the first power line 41, a first electrode of a third switch element T13, and a first electrode of the capacitor Cst.

A first switch element T11 is turned on according to the gate-on voltage VGL of the Nth scan signal SCAN(N) to connect a gate and a second electrode of a driving element DT. The first switch element T11 includes a gate connected to a second gate line 1035, a first electrode connected to the second node n12, and a second electrode connected to a third node n13. The Nth scan signal SCAN(N) is supplied to pixels P through the second gate line 1035. The third node n13 is connected to the second electrode of the driving element DT, the second electrode of the first switch element T11, and a first electrode of a fourth switch element T14.

A second switch element T12 is turned on according to the gate-on voltage VGL of the Nth scan signal SCAN(N) to apply the data voltage Vdata to a first electrode of the driving element DT. The second switch element T12 includes a gate connected to the second gate line 1035, a first electrode connected to a fifth node n15, and a second electrode connected to the data line 102. The fifth node n15 is connected to the first electrode of the driving element DT, the first electrode of the second switch element T12, and a second electrode of the third switch element T13.

The third switch element T13 supplies the pixel driving voltage ELVDD to the first electrode of the driving element DT in response to the EM signal EM(N). The third switch element T13 includes a gate connected to a third gate line 1036, the first electrode connected to the first power line 41, and the second electrode connected to the fifth node n15. The EM signal EM(N) is supplied to the pixels P through the third gate line 1036.

The fourth switch element T14 is turned on according to the gate-on voltage VGL of the EM signal EM(N) to connect the second electrode of the driving element DT to an anode of a light-emitting element EL. A gate of the fourth switch element T14 is connected to the third gate line 1036. The first electrode of the fourth switch element T14 is connected to the third node n13, and a second electrode of the fourth switch element T14 is connected to a fourth node n14. The fourth node n14 is connected to the anode of the light-emitting element EL, the second electrode of the fourth switch element T14, and a second electrode of a sixth switch element T16.

A fifth switch element T15 is turned on according to the gate-on voltage VGL of the N−1th scan signal SCAN(N−1) to connect the second node n12 to a third power line 44 to initialize the capacitor Cst and the gate of the driving element DT during the initialization operation Ti. The fifth switch element T15 includes a gate connected to a first gate line 1034, a first electrode connected to the second node n12, and a second electrode connected to the third power line 44.

The N−1th scan signal SCAN(N−1) is supplied to the pixels P through the first gate line 1034. The initialization voltage Vini is supplied to the pixels P through the third power line 44.

The sixth switch element T16 is turned on according to the gate-on voltage VGL of the N−1th scan signal SCAN (N−1) to connect the third power line 44 to the anode of the light-emitting element EL during the initialization operation Ti. During the initialization operation Ti, an anode voltage of the light-emitting element EL is discharged to the initialization voltage Vini through the sixth switch element T16. In this case, since a voltage between the anode and cathode of the light-emitting element EL is less than a threshold voltage of the light-emitting element EL, the light-emitting element EL does not emit light. The sixth switch element T16 includes a gate connected to the first gate line 1034, a first electrode connected to the third power line 44, and the second electrode connected to the fourth node n14.

The driving element DT controls current flowing through the light-emitting element EL according to a gate-source voltage Vgs thereof to drive the light-emitting element EL. The driving element DT includes the gate connected to the second node n12, the first electrode connected to the fifth node n15, and the second electrode connected to the third node n13.

The pixel circuit shown in FIG. 8 includes an internal compensation circuit. An operation of the internal compensation circuit may be divided into an initialization operation Ti, a sensing operation Ts, and an emission operation Tem.

In the initialization operation Ti, the fourth and fifth switch elements T14 and T15 are turned on according to the gate-on voltage VGL of the N−1th scan signal SCAN(N−1). At this point, a voltage of each of the second and fourth nodes n12 and n14 is discharged to the initialization voltage Vini. As a result, in the initialization operation Ti, the capacitor Cst, a gate voltage of the driving element DT, and the anode voltage of the light-emitting element EL are initialized to the initialization voltage Vini.

In the sensing operation Ts, the first and second switch elements T11 and T12 are turned on according to the gate-on voltage VGL of the Nth scan signal SCAN(N). At this point, the data voltage Vdata is applied to the fifth node n15, and the voltage of the second node n12 is changed to Vdata+Vth. As a result, a threshold voltage Vth of the driving element DT is sensed in the sensing operation Ts and is charged to the second node n12. During the sensing operation Ts, the data voltage Vdata compensated for by the threshold voltage Vth of the driving element DT is charged in the capacitor Cst.

The voltage of the EM signal EM(N) is inverted to the gate-on voltage VEL in the emission operation Tem. The third and fourth switch elements T13 and T14 are turned on in the emission operation Tem. During the emission operation Tem, current may flow through the driving element DT to the light-emitting element EL so that the light-emitting element EL may emit light.

The current flowing through the light-emitting element EL is adjusted according to a gate-source voltage Vgs of the driving element DT. During the emission operation Tem, the gate-source voltage Vgs of the driving element DT is equal to Vdata+Vth-ELVDD.

The power supply unit 140 includes a first gamma reference voltage generation circuit configured to output a gamma reference voltage R1-*n* for a first color according to a first register setting value, a second gamma reference voltage generation circuit configured to output a gamma reference voltage G1-*n* for a second color according to a second register setting value, and a third gamma reference voltage generation circuit configured to output a gamma reference voltage B1-*n* for a third color according to a third register setting value. Accordingly, the power supply unit 140 generates independent gamma reference voltages for each color. The emission layer of the light-emitting element has different efficiency for each color due to material properties thereof, and thus the gamma compensation voltages have to be independently set for each color to realize optimum image quality. The independent gamma reference voltages R1-*n*, G1-*n*, and B1-*n* for each color are supplied to voltage divider circuits 91 to 93 of the data driving unit 110 shown in FIG. 9.

Figure 9:
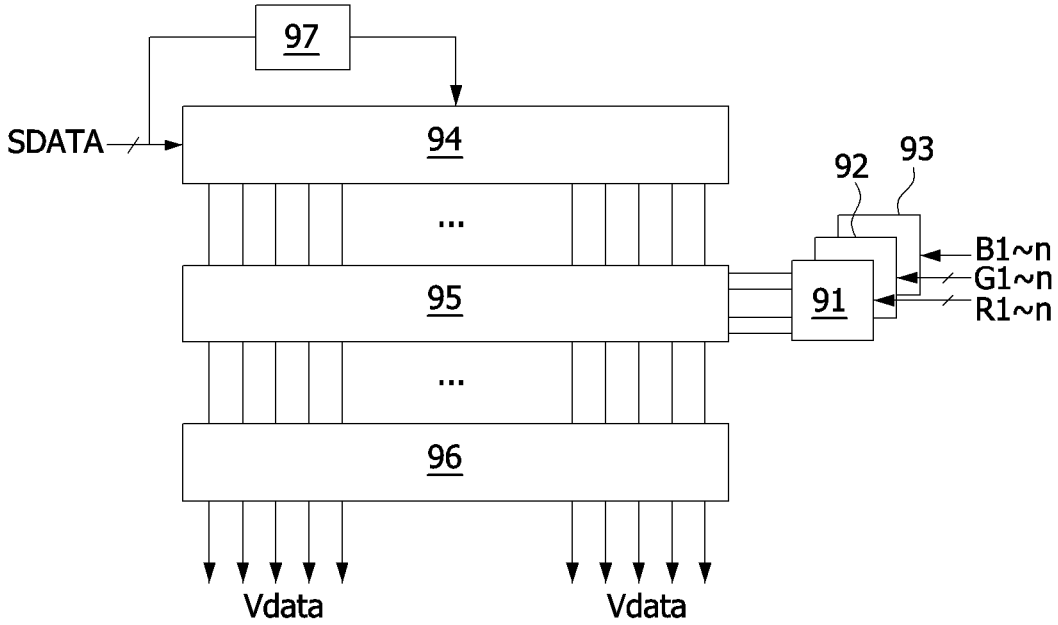
FIG. 9 is a schematic block diagram illustrating a circuit configuration of a data driving unit.

FIG. 9 is a schematic block diagram illustrating a circuit configuration of the data driving unit 110. The data driving unit 110 may be implemented as one or more driver ICs each having the circuit configuration shown in FIG. 9.

The data driving unit 110 includes a serial-to-parallel converter 94, a clock recovery unit 97, a DAC 95, an output unit 96, and a plurality of voltage divider circuits 91 to 93.

The timing controller 130 may transmit serial data SDATA to the data driving unit 110 as a digital signal of a differential signal. The serial data SDATA may include pixel data of an input image, non-display data that is not written to the pixel, and a clock.

The clock recovery unit 97 multiplies the clock received from the timing controller 130 using a phase-locked loop (PLL) or a delay-locked loop (DLL), generates a clock for data sampling, and provides the generated clock to the serial-to-parallel converter 94. The serial-to-parallel converter 94 samples the serial data SDATA, which is received from the timing controller 130, according to the clock received from the clock recovery unit 97, and converts the sampled serial data into parallel data. The serial-to-parallel converter 94 may include a shift register and a latch. The latch simultaneously outputs data from a plurality of channels in response to a source output enable signal SOE received from the timing controller 130.

The voltage divider circuits 91 to 93 each divide the gamma reference voltage using a plurality of resistors connected in series and output a gamma compensation voltage for each grayscale of each color. In each color, the gamma reference voltage may be generated as voltages of 10 different voltage levels. The gamma reference voltage may be divided into gamma compensation voltages for each of 256 or 1024 grayscales by the voltage divider circuits 91 to 93.

A first voltage divider circuit 91 divides the gamma reference voltage R1-*n* for the first color and supplies gamma compensation voltages for each grayscale of the first color to the DAC 95. A second voltage divider circuit 92 divides the gamma reference voltage G1-*n* for the second color and supplies gamma compensation voltages for each grayscale of the second color to the DAC 95. A third voltage divider circuit 93 divides the gamma reference voltage B1-*n* for the third color and supplies gamma compensation voltages for each grayscale of the third color to the DAC 95.

The DAC 95 converts the digital data input from the serial-to-parallel converter 94 using the gamma compensation voltages, which are independent for each color, provided from the voltage divider circuits 91 to 93, and outputs a data voltage Vdata that is set to a target voltage of each grayscale. The data voltages Vdata may be transmitted to the data lines 102 through the output unit 96 using the multiplexer array 112 or may be directly applied to the data lines 102. The output unit 96 outputs the data voltage through the output buffer AMP that is connected to an output node of the DAC 95 for each channel.

When the data voltages of different colors are distributed to the data lines through the demultiplexer to reduce the number of channels of the data driving unit, degradation in image quality may occur. This will be described with reference to FIGS. 10 and 11.

Figure 10:
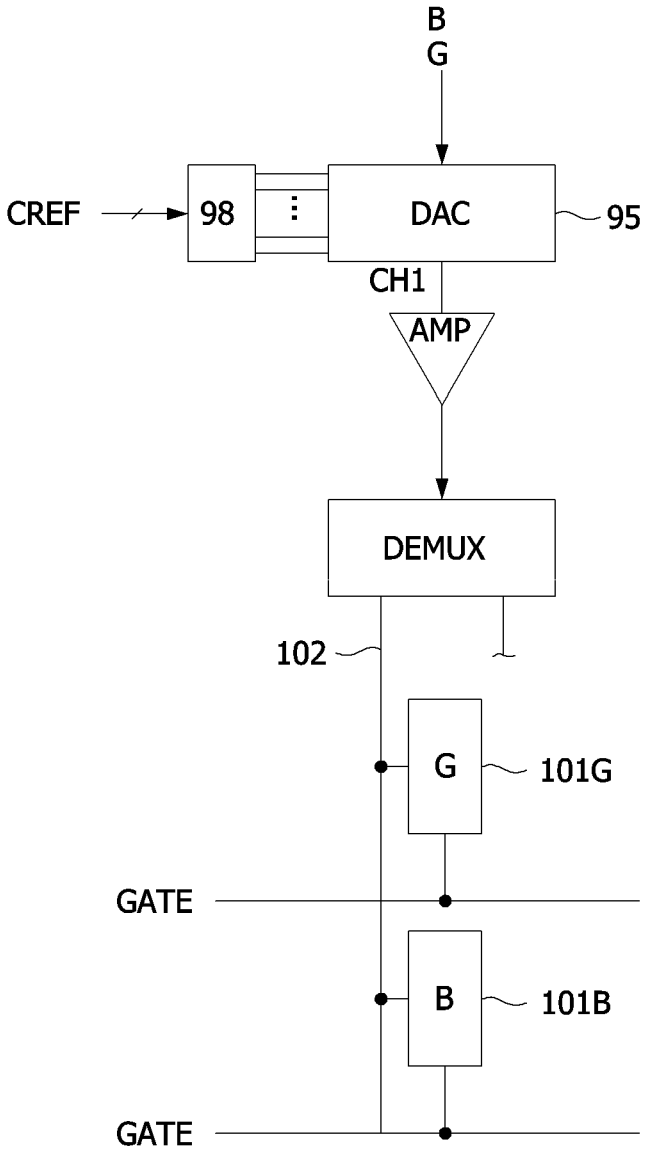
FIG. 10 is a diagram illustrating an example of supplying a data voltage to sub-pixels of two colors using a common gamma reference voltage.

FIG. 10 is a diagram illustrating an example of supplying the data voltage to sub-pixels of two colors using a common gamma reference voltage.

Referring to FIG. 10, a common voltage divider circuit 98 may be connected to the DAC 95. The common voltage divider circuit 98 divides a common gamma reference voltage CREF and provides common gamma compensation voltages to the DAC 95. The gamma compensation voltages output from the common voltage divider circuit 98 are converted into data voltages for two colors.

First data G to be written to a sub-pixel 101G of the first color and second data B to be written to a sub-pixel 101B of the second color are sequentially input to the DAC 95. The DAC 95 converts the first and second data G and B using the common gamma compensation voltages to output a first data voltage and then output a second data voltage.

A demultiplexer DEMUX supplies the first data voltage to the data line 102 and then supplies the second data voltage to the data line 102. Thus, after the first data voltage, which is converted using the common gamma compensation voltage, is applied to the sub-pixel 101G for the first color, the second data voltage is applied to the sub-pixel 101B for the second color.

Figure 11:
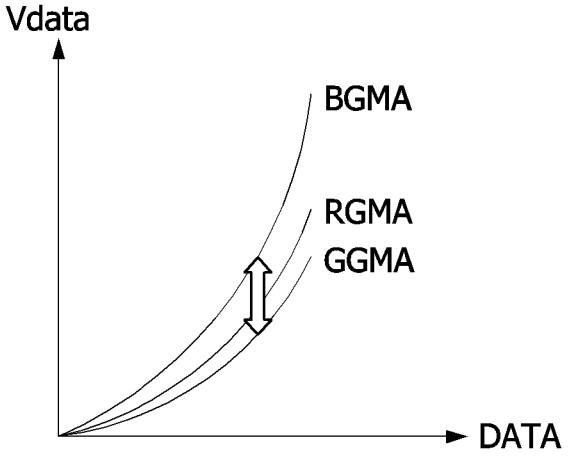
FIG. 11 is a graph illustrating a gamma curve of each color.

Since efficiency of an emission layer is different for each color, as shown in FIG. 11, a data voltage should be set differently according to a grayscale of data DATA for each color in order to obtain ideal optical compensation. In FIG. 11, "RGMA" is a gamma curve for red and "GGMA" is a gamma curve for green. "BGMA" in FIG. 11 is a gamma curve for blue. Meanwhile, the common gamma compensation voltage is generated based on the gamma reference voltage having a higher value among the gamma curves of two colors. In the example illustrated with reference to FIG. 10, the data voltage to be applied to the blue and green sub-pixels is obtained from the common gamma compensation voltage and thus has the same voltage level in the same grayscale. In this case, since the green sub-pixel does not emit light with brightness of an ideal gamma curve, the image quality is degraded.

The data driving unit 110 of the present disclosure applies an independent gamma compensation voltage in each color to have compatibility with sub-pixel rendering performed in various ways without causing degradation in image quality. Thus, according to the present disclosure, the components of the data driving unit 110 may be shared without causing the degradation in image quality by in various models of display devices having different sub-pixel arrangement structures.

Figure 12A:
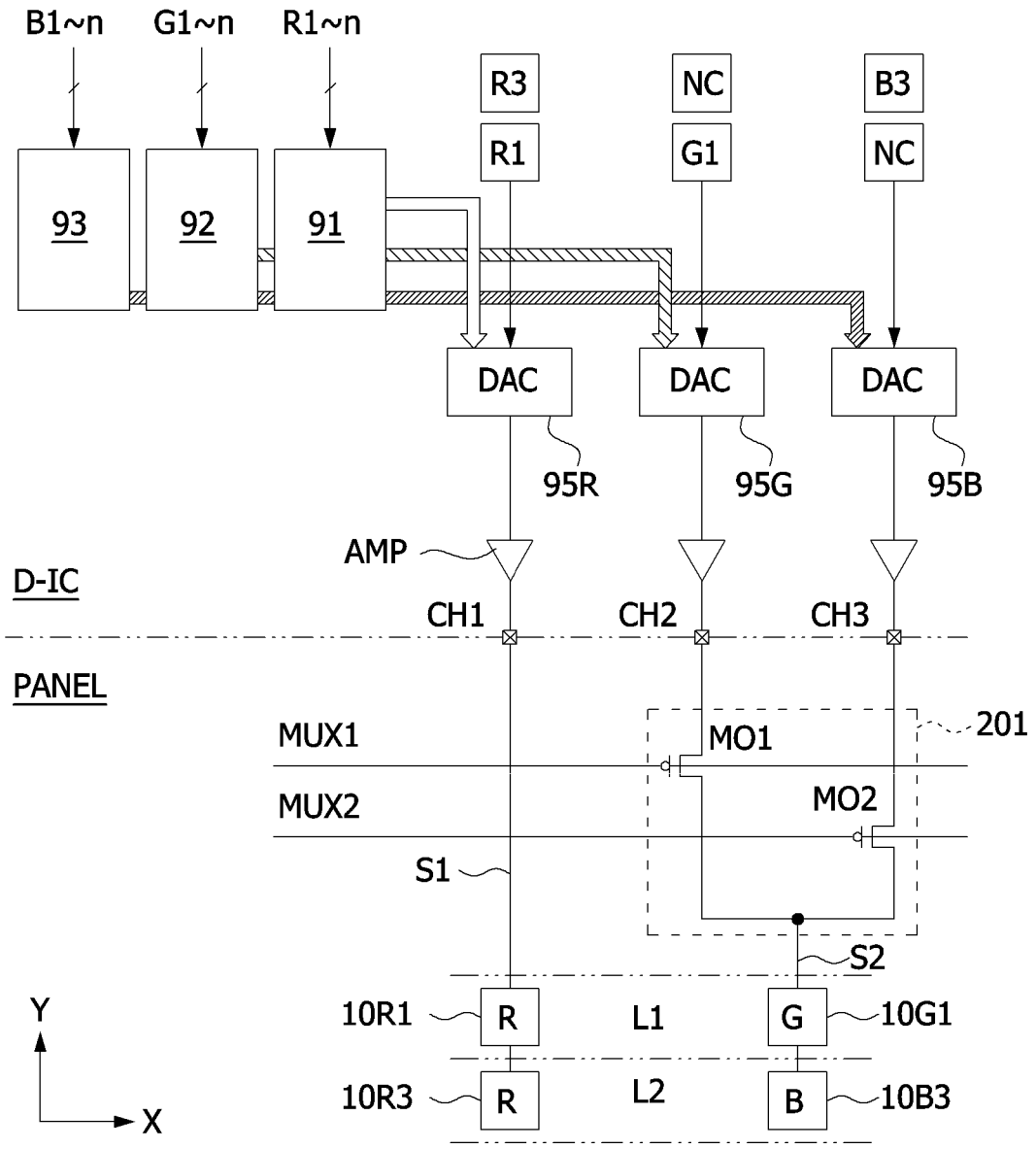
FIGS. 12A and 12B are diagrams illustrating a data driving unit, a multiplexer, and a pixel array according to a first embodiment of the present disclosure.
Figure 12B:
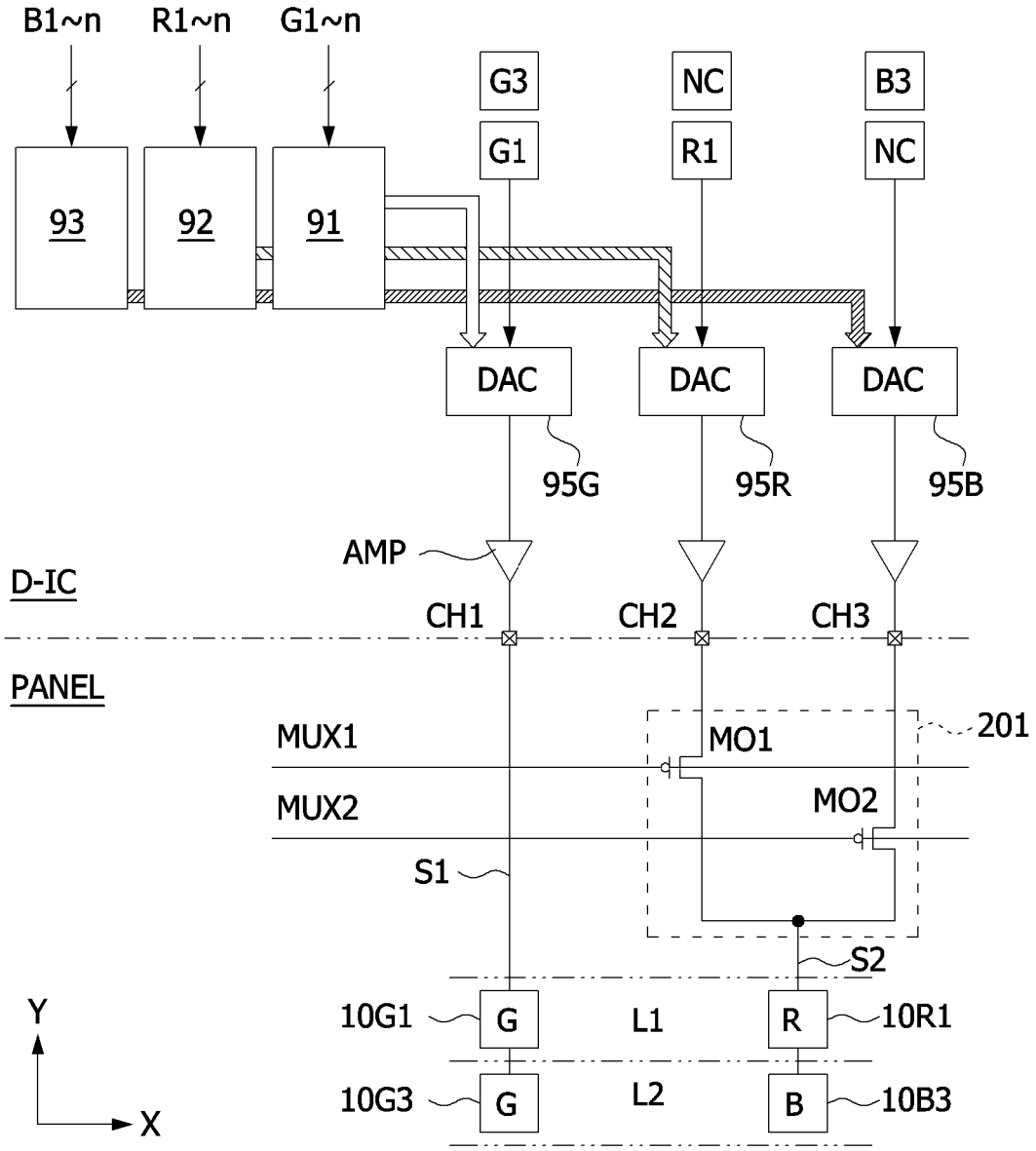

FIGS. 12A and 12B are diagrams illustrating a data driving unit, a multiplexer, and a pixel array according to a first embodiment of the present disclosure. In FIGS. 12A and 12B, a serial-to-parallel converter 94, a clock recovery unit 97, and the like are omitted, and for a pixel array, only some sub-pixels are briefly illustrated. In FIGS. 12A and 12B, "D-IC" represents a driver IC in which the data driving unit is integrated. "PANEL" represents a display panel 100. In a sub-pixel arrangement in FIGS. 12A and 12B, one pixel may include sub-pixels for two colors. In this case, the timing controller 130 may convert data into an average value of the data of the same color in neighboring pixels and transmit the converted data to a data driving unit 110.

Referring to FIG. 12A, the data driving unit 110 includes a first voltage divider circuit 91 configured to output a gamma compensation voltage for each grayscale of a first color, a second voltage divider circuit 92 configured to output a gamma compensation voltage for each grayscale of a second color, a third voltage divider circuit 93 configured to output a gamma compensation voltage for each grayscale of a third color, a first DAC 95R connected to the first voltage divider circuit 91, a second DAC 95G connected to the second voltage divider circuit 92, a third DAC 95B connected to the third voltage divider circuit 93, and the like.

In FIG. 12A, "R1" and "G1" may be first pixel data to be input to odd-numbered pixel of a first pixel line L1. "R3" and "B3" may be third pixel data to be input to odd-numbered pixel of a second pixel line L2.

Second and third channels CH2 and CH3 of the data driving unit 110 are connected to a multiplexer 201. The multiplexer 201 may be disposed on the display panel PANEL. It should be noted that the multiplexer 201 is different from the input/output structure of the demultiplexer applied to reduce the number of channels in the above-described embodiment. The multiplexer 201 has i (where i is a positive integer) input nodes and j (where j is a positive integer) output nodes. In the drawing, the multiplexer 201 is illustrated as being a 2:1 multiplexer, but the present disclosure is not limited thereto. The demultiplexer outputs N data voltages by dividing one horizontal period, and thus the time to charge a data voltage to each pixel is reduced to 1/N. In contrast, since the multiplexer 201 charges a data voltage during one horizontal period, it is possible to sufficiently secure the time to charge the data voltage to each pixel.

The multiplexer 201 may include first and second switch elements M01 and M02. The first switch element M01 is connected between the second channel CH2 of the data driving unit 110 and a second data line S2. The first switch element M01 is turned on in response to a pulse of a first MUX signal MUX1 to supply a data voltage received through the second channel CH2 to the second data line S2 during a first horizontal period. The second switch element M02 is turned on in response to a pulse of a second MUX signal MUX2 to supply a data voltage received through the third channel CH3 to the second data line S2 during a second horizontal period. The pulse of each of the MUX signals MUX1 and MUX2 is generated as a gate-on voltage VGL. A pulse width W of each of the MUX signals MUX1 and MUX2 may be approximately set to a time obtained by subtracting a horizontal blank period HB from one horizontal period 1H. The second MUX signal MUX2 is phase-delayed relative to the first MUX signal MUX1. The first and second switch elements M01 and M02 may be alternately turned on and off in units of one horizontal period in response to the MUX signals MUX1 and MUX2.

It should be noted that the multiplexer 201 is different from the input/output structure of the demultiplexer applied to reduce the number of channels in the above-described embodiment. The multiplexer 201 has N input nodes and one output node. In the drawing, the multiplexer 201 is illustrated as being a 2:1 multiplexer, but the present disclosure is not limited thereto.

The first DAC 95R is disposed in a first channel CH1 of the data driving unit 110. The first DAC 95R converts the first and second data R1 and R3 for the first color, which are input from the serial-to-parallel converter 94, using the gamma compensation voltage for the first color received from the first voltage divider circuit 91 to output a first R data voltage during the first horizontal period and then output a second R data voltage during the second horizontal period. The first and second R data voltages output from the first DAC 95R are directly applied to a first data line S1 through an output buffer of the first channel CH1. An R sub-pixel 10R1 of the first pixel line L1 is charged with the first R data voltage during the first horizontal period. An R sub-pixel 10R3 of the second pixel line L2 is charged with the second R data voltage during the second horizontal period.

The second DAC 95G is disposed in the second channel CH2 of the data driving unit 110. The third DAC 95B is disposed in the third channel CH3 of the data driving unit 110. The second and third channels CH2 and CH3 of the data driving unit 110 are connected to the multiplexer 201.

The second DAC 95G converts the data G1 for the second color and non-display data NC, which are input from the serial-to-parallel converter 94, using the gamma compensation voltage for the second color received from the second voltage divider circuit 92 to output a G data voltage during the first horizontal period and then output an invalid data voltage during the second horizontal period. The G data voltage output from the second DAC 95G is applied to the second data line S2 through the first switch element M01 of the multiplexer 201 during the first horizontal period. The G data voltage is charged to a G sub-pixel 10G1 of the first pixel line L1 during the first horizontal period. On the other hand, the invalid data voltage is not transmitted to the second data line S2 because the first switch element M01 is in an off state in the second horizontal period and is changed into a G data voltage that is output during a third horizontal period. Accordingly, the non-display data input to the second DAC 95G is not output from the data driving unit 110 and is overwritten by next valid data and discarded.

The third DAC 95B converts the non-display data NC and the data B3 for the third color, which are input from the serial-to-parallel converter 94, using the gamma compensation voltage for the third color received from the third voltage divider circuit 93 to output the invalid data voltage during the first horizontal period and then output a B data voltage during the second horizontal period. The B data voltage output from the third DAC 95B is applied to the second data line S2 through the second switch element M02 of the multiplexer 201 during the second horizontal period. On the other hand, the invalid data voltage is not transmitted to the second data line S2 because the second switch element M02 is in an off state in the first horizontal period and is changed into the B data voltage that is output during the second horizontal period. Accordingly, the non-display data input to the third DAC 95B is not output from the data driving unit 110 and is overwritten by next valid data and discarded.

The data driving unit 110, the multiplexer 201, and the sub-pixels shown in FIG. 12B have substantially the same structures as those of the embodiment described with reference to FIG. 12A, but the colors are different. A detailed description of parts that are substantially the same as those of the above-described embodiment will be omitted in FIG. 12B.

Referring to FIG. 12B, the first voltage divider circuit 91 divides the gamma reference voltage G1-*n* for the first color to supply a gamma compensation voltage for each grayscale of the first color to a first DAC 95G. The second voltage divider circuit 92 divides the gamma reference voltage R1-*n* for the second color to supply a gamma compensation voltage for each grayscale of the second color to a second DAC 95R. The third voltage divider circuit 93 divides the gamma reference voltage B1-*n* for the third color to supply the gamma compensation voltage for each grayscale of the third color to a third DAC 95B. The gamma reference voltage for each color may be adjusted in level according to a register setting value of a programmable gamma IC and may be changed to a gamma reference voltage for another color.

The first DAC 95G is disposed in the first channel CH1 of the data driving unit 110. The first DAC 95G converts first and second data G1 and G3 for the first color, which are input from the serial-to-parallel converter 94, using the gamma compensation voltage for the first color received from the first voltage divider circuit 91 to output a first G data voltage during the first horizontal period and then output a second G data voltage during the second horizontal period. The first and second G data voltages output from the first DAC 95G are directly applied to the first data line S1 through the output buffer of the first channel CH1. A G sub-pixel 10G1 of the first pixel line L1 is charged with the first G data voltage during the first horizontal period. A G sub-pixel 10G3 of the second pixel line L2 is charged with the second G data voltage during the second horizontal period.

The second DAC 95R converts data R1 for the second color and non-display data NC, which are input from the serial-to-parallel converter 94, using the gamma compensation voltage for the second color received from the second voltage divider circuit 92 to output an R data voltage during the first horizontal period and then output an invalid data voltage during the second horizontal period. The R data voltage output from the second DAC 95R is applied to the second data line S2 through the first switch element M01 of the multiplexer 201 during the first horizontal period. An R sub-pixel 10R1 of the first pixel line L1 is charged with the R data voltage during the first horizontal period. On the other hand, the invalid data voltage is not transmitted to the second data line S2 because the first switch element M01 is in an off state in the second horizontal period.

The third DAC 95B converts the non-display data NC and data B3 for the third color, which are input from the serial-to-parallel converter 94, using the gamma compensation voltage for the third color received from the third voltage divider circuit 93 to output the invalid data voltage during the first horizontal period and then output a B data voltage during the second horizontal period. The B data voltage output from the third DAC 95B is applied to the second data line S2 through the second switch element M02 of the multiplexer 201 during the second horizontal period. On the other hand, the invalid data voltage is not transmitted to the second data line S2 because the second switch element M02 is in an off state in the first horizontal period.

According to the present disclosure, pixels are driven with a gamma compensation voltage for each color, which is optimized for gamma characteristics of each color, so that image quality may be improved and charging time of the pixels may be increased. Furthermore, according to the present disclosure, even when a horizontal period is reduced due to an increase in resolution of a display panel, the charging time of the pixels may be secured.

Figure 13:
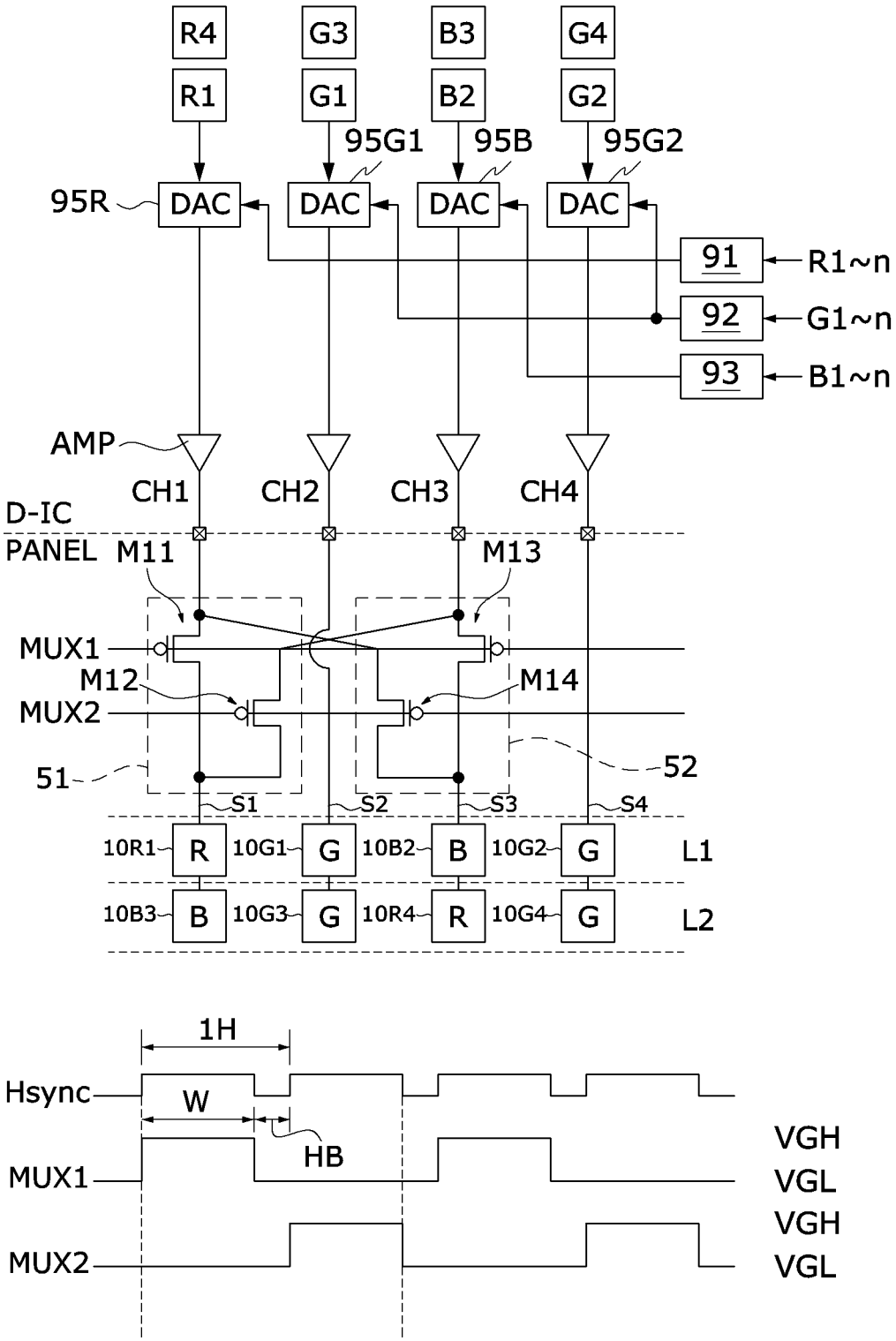
FIG. 13 is a diagram illustrating a data driving unit, a multiplexer, and a pixel array according to a second embodiment of the present disclosure.

FIG. 13 is a diagram illustrating a data driving unit, a multiplexer, and a pixel array according to a second embodiment of the present disclosure. In FIG. 13, the serial-to-parallel converter 94, a clock recovery unit 97, and the like are omitted, and for a pixel array, only some sub-pixels are briefly illustrated. In FIG. 13, one pixel may include sub-pixels for two colors. In this case, the timing controller 130 may convert data into an average value of the data of the same color in neighboring pixels and transmit the converted data to a data driving unit 110.

Referring to FIG. 13, the data driving unit 110 includes a first voltage divider circuit 91 configured to output a gamma compensation voltage for each grayscale of a first color, a second voltage divider circuit 92 configured to output a gamma compensation voltage for each grayscale of a second color, a third voltage divider circuit 93 configured to output a gamma compensation voltage for each grayscale of a third color, a first DAC 95R connected to the first voltage divider circuit 91, second and fourth DACs 95G1 and 95G2 connected to the second voltage divider circuit 92, a third DAC 95B connected to the third voltage divider circuit 93, and the like.

The first voltage divider circuit 91 divides the gamma reference voltage R1-*n* for the first color to supply the gamma compensation voltage for each grayscale of the first color to the first DAC 95R. The second voltage divider circuit 92 divides the gamma reference voltage G1-*n* for the second color and supplies the gamma compensation voltages for each grayscale of the second color to the second and fourth DACs 95G1 and 95G2. The third voltage divider circuit 93 divides the gamma reference voltage B1-*n* for the third color to supply the gamma compensation voltage for each grayscale of the third color to the third DAC 95B.

First and third channels CH1 and CH3 of the data driving unit 110 are connected to multiplexers 51 and 52, respectively. The multiplexers 51 and 52 may be disposed on a display panel PANEL.

A first multiplexer 51 may include first and second switch elements M11 and M12. The first switch element M11 is connected between the first channel CH1 of the data driving unit 110 and a first data line S1. The first switch element M11 is turned on in response to a pulse of a first MUX signal MUX1 during a first horizontal period to supply a data voltage received through the first channel CH1 to the first data line S1. The second switch element M12 is connected between the third channel CH3 of the data driving unit 110 and the first data line S1. The second switch element M12 is turned on in response to a pulse of a second MUX signal MUX2 during a second horizontal period to supply a data voltage received through the third channel CH3 to the first data line S1. The second MUX signal MUX2 is phase-delayed relative to the first MUX signal MUX1. The first and second switch elements M11 and M12 may be alternately turned on and off in units of one horizontal period in response to the MUX signals MUX1 and MUX2.

A second multiplexer 52 may include third and fourth switch elements M13 and M14. The third switch element M13 is connected between the third channel CH3 of the data driving unit 110 and a third data line S3. The third switch element M13 is turned on in response to the pulse of the first MUX signal MUX1 during the first horizontal period to supply a data voltage received through the third channel CH3 to the third data line S3. The fourth switch element M14 is connected between the first channel CH1 of the data driving unit 110 and the third data line S3. The fourth switch element M14 is turned on in response to the pulse of the second MUX signal MUX2 during the second horizontal period to supply the data voltage received through the first channel CH1 to the third data line S3.

The first DAC 95R is disposed in the first channel CH1 of the data driving unit 110. The first DAC 95R converts first and second data R1 and R4 for the first color using the gamma compensation voltage for the first color received from the first voltage divider circuit 91 to output a first R data voltage during the first horizontal period and then output a second R data voltage during the second horizontal period. The first R data voltage output from the first DAC 95R is applied to the first data line S1 through the first switch element M11 during the first horizontal period. The second R data voltage output from the first DAC 95R is applied to the third data line S3 through the fourth switch element M14 during the second horizontal period. An R sub-pixel 10R1 of a first pixel line L1 is charged with the first R data voltage during the first horizontal period. An R sub-pixel 10R4 of a second pixel line L2 is charged with the second R data voltage during the second horizontal period.

The second DAC 95G1 is disposed in a second channel CH2 of the data driving unit 110. The second DAC 95G1 converts first and second data G1 and G3 for the second color, which are input from the serial-to-parallel converter 94, using the gamma compensation voltage for the second color received from the second voltage divider circuit 92 to output a first G data voltage during the first horizontal period and then output a second G data voltage during the second horizontal period. The first and second G data voltages output from the second DAC 95G1 are directly applied to a second data line S2 through an output buffer of the second channel CH2. A G sub-pixel 10G1 of the first pixel line L1 is charged with the first G data voltage during the first horizontal period. A G sub-pixel 10G3 of the second pixel line L2 is charged with the second G data voltage during the second horizontal period.

The third DAC 95B is disposed in the third channel CH3 of the data driving unit 110. The third DAC 95B converts first and second data B2 and B3 for the third color using the gamma compensation voltage for the third color received from the third voltage divider circuit 93 to output a first B data voltage during the first horizontal period and then output a second B data voltage during the second horizontal period. The first B data voltage output from the third DAC 95B is applied to the third data line S3 through the third switch element M13 during the first horizontal period. The second B data voltage output from the third DAC 95B is applied to the first data line S1 through the second switch element M12 during the second horizontal period. A B sub-pixel 10B2 of a first pixel line L1 is charged with the first B data voltage during the first horizontal period. A B sub-pixel 10B3 of the second pixel line L2 is charged with the second B data voltage during the second horizontal period.

The fourth DAC 95G2 is disposed in a fourth channel CH4 of the data driving unit 110. The fourth DAC 95G2 converts first and second data G2 and G4 for the second color, which are input from the serial-to-parallel converter 94, using the gamma compensation voltage for the second color received from the second voltage divider circuit 92 to output a first G data voltage during the first horizontal period and then output a second G data voltage during the second horizontal period. The first and second G data voltages output from the fourth DAC 95G2 are directly applied to a fourth data line S4 through an output buffer of the fourth channel CH4. A G sub-pixel 10G2 of the first pixel line L1 is charged with the first G data voltage during the first horizontal period. A G sub-pixel 10G4 of the second pixel line L2 is charged with the second G data voltage during the second horizontal period.

In FIG. 13, the colors may be changed. For example, green (G) may be changed to red (R), and blue (B) and red (R) may be respectively changed to green (G) and blue (B).

Figure 14:
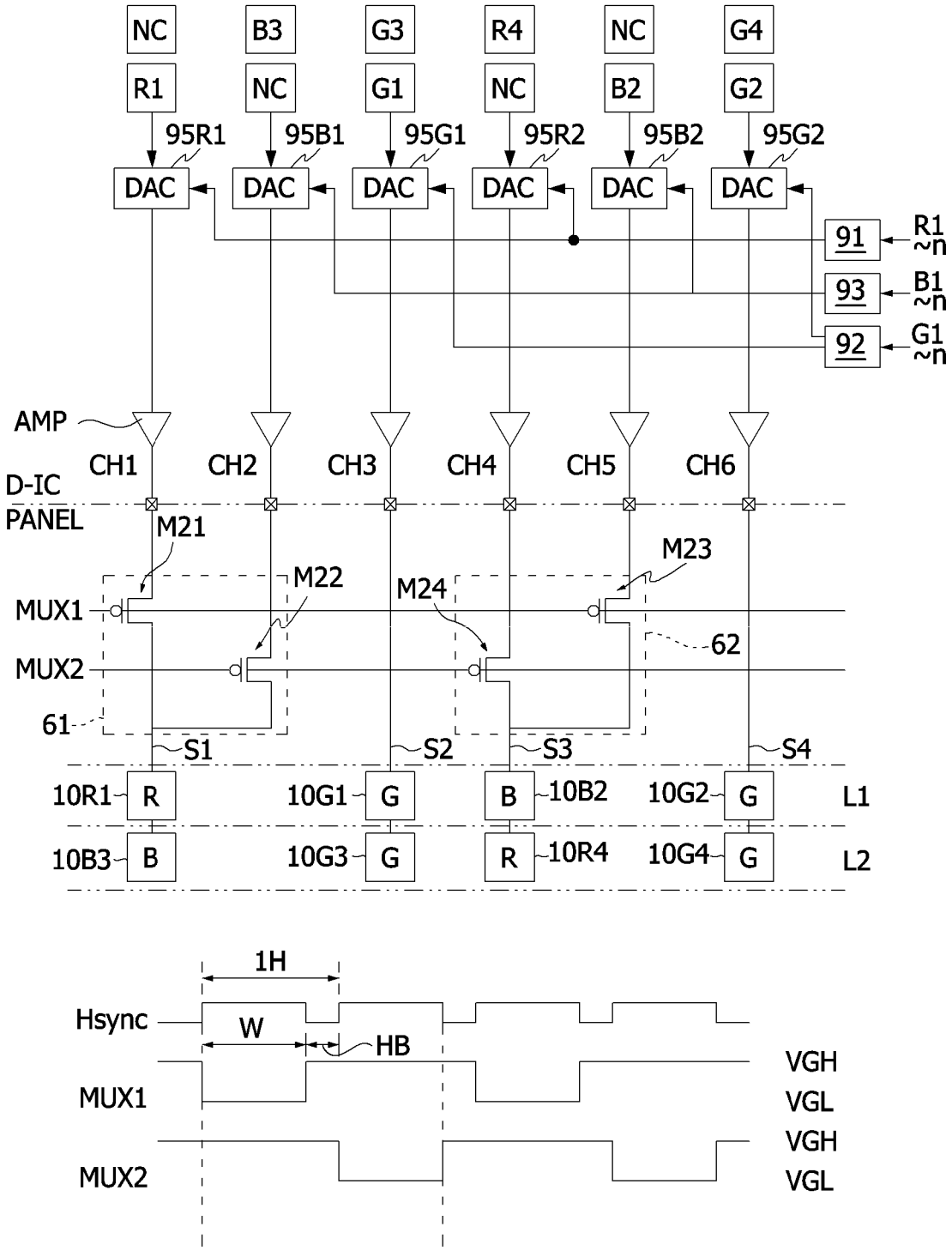
FIG. 14 is a diagram illustrating a data driving unit, a multiplexer, and a pixel array according to a third embodiment of the present disclosure.

FIG. 14 is a diagram illustrating a data driving unit, a multiplexer, and a pixel array according to a third embodiment of the present disclosure.

Referring to FIG. 14, a data driving unit 110 includes a first voltage divider circuit 91 configured to output a gamma compensation voltage for each grayscale of a first color, a second voltage divider circuit 92 configured to output a gamma compensation voltage for each grayscale of a second color, a third voltage divider circuit 93 configured to output a gamma compensation voltage for each grayscale of a third color, first and fourth DACs 95R1 to 95R2 connected to the first voltage divider circuit 91, second and fifth DACs 95B1 to 95B2 connected to the second voltage divider circuit 92, third and sixth DACs 95G1 to 95G2 connected to the third voltage divider circuit 93, and the like.

The first voltage divider circuit 91 divides the gamma reference voltage R1-*n* for the first color to supply the gamma compensation voltage for each grayscale of the first color to the first and fourth DACs 95R1 to 95R2. The second voltage divider circuit 92 divides the gamma reference voltage B1-*n* for the second color to supply the gamma compensation voltage for each grayscale of the second color to the second and fifth DACs 95B1 to 95B2. The third voltage divider circuit 93 divides the gamma reference voltage G1-*n* for the third color to supply the gamma compensation voltage for each grayscale of the third color to the third and sixth DACs 95G1 to 95G2. The gamma reference voltage for each color may be adjusted in level according to a register setting value of a programmable gamma IC and may be changed to a gamma reference voltage for another color.

First and second channels CH1 and CH2 of the data driving unit 110 are connected to a first multiplexer 61, and fourth and fifth channels CH4 and CH5 are connected to a second multiplexer 62. The multiplexers 61 and 62 may be disposed on a display panel PANEL.

The first multiplexer 61 may include first and second switch elements M21 and M22. The first switch element M21 is connected between the first channel CH1 of the data driving unit 110 and a first data line S1. The first switch element M11 is turned on in response to a pulse of a first MUX signal MUX1 during a first horizontal period to supply a data voltage received through the first channel CH1 to the first data line S1. The second switch element M22 is connected between the second channel CH2 of the data driving unit 110 and the first data line S1. The second switch element M12 is turned on in response to a pulse of a second MUX signal MUX2 during a second horizontal period to supply a data voltage received through the second channel CH2 to the first data line S1.

The second multiplexer 62 may include third and fourth switch elements M23 and M24. The third switch element M23 is connected between the fifth channel CH5 of the data driving unit 110 and a third data line S3. The third switch element M23 is turned on in response to the pulse of the first MUX signal MUX1 during the first horizontal period to supply a data voltage received through the fifth channel CH5 to the third data line S3. The fourth switch element M24 is connected between the fourth channel CH4 of the data driving unit 110 and the third data line S3. The fourth switch element M24 is turned on in response to the pulse of the second MUX signal MUX2 during the second horizontal period to supply a data voltage received through the fourth channel CH4 to the third data line S3. The first DAC 95R1 is disposed in the first channel CH1 of the data driving unit 110. The first DAC 95R1 converts data R1 for the first color and non-display data NC using the gamma compensation voltage for the first color received from the first voltage divider circuit 91 to output an R data voltage during the first horizontal period and then output an invalid data voltage during the second horizontal period. The R data voltage output from the first DAC 95R1 is applied to the first data line S1 through the first switch element M21 during the first horizontal period. An R sub-pixel 10R1 of a first pixel line L1 is charged with the R data voltage during the first horizontal period. The invalid data voltage is not transmitted to the first data line S1 because the first switch element M21 is in an off state in the second horizontal period.

The second DAC 95B1 is disposed in the second channel CH2 of the data driving unit 110. The second DAC 95B1 converts the non-display data NC and data B3 for the second color, which are input from the serial-to-parallel converter 94, using the gamma compensation voltage for the second color received from the second voltage divider circuit 92 to output the invalid data voltage during the first horizontal period and then output a B data voltage during the second horizontal period. The invalid data voltage is not transmitted to the first data line S1 because the second switch element M22 is in an off state in the first horizontal period. The B data voltage output from the second DAC 95B1 is applied to the first data line S1 through the output buffer of the second channel CH2 and the second switch element M22. A B sub-pixel 10B3 of a second pixel line L2 is charged with the B data voltage during the second horizontal period.

The third DAC 95G1 is disposed in a third channel CH3 of the data driving unit 110. The third DAC 95G1 converts first and second data G1 and G3 for the third color, which are input from the serial-to-parallel converter 94, using the gamma compensation voltage for the third color received from the third voltage divider circuit 93 to output a first G data voltage during the first horizontal period and then output a second G data voltage during the second horizontal period. The first and second G data voltages output from the third DAC 95G1 are directly applied to a second data line S2 through an output buffer of the third channel CH3. A G sub-pixel 10G1 of the first pixel line L1 is charged with the first G data voltage during the first horizontal period. A G sub-pixel 10G3 of the second pixel line L2 is charged with the second G data voltage during the second horizontal period.

The fourth DAC 95R2 is disposed in the fourth channel CH4 of the data driving unit 110. The fourth DAC 95R2 converts data R4 for the first color and the non-display data NC using the gamma compensation voltage for the first color received from the first voltage divider circuit 91 to output the invalid data voltage during the first horizontal period and then output an R data voltage during the second horizontal period. The invalid data voltage is not transmitted to the third data line S3 because the fourth switch element M24 is in an off state during the first horizontal period. The R data voltage output from the fourth DAC 95R2 is applied to the third data line S3 through the fourth switch element M24 during the second horizontal period. An R sub-pixel 10R4 of the second pixel line L2 is charged with the R data voltage output from the fourth DAC 95R2 during the second horizontal period.

The fifth DAC 95B2 is disposed in the fifth channel CH5 of the data driving unit 110. The fifth DAC 95B2 converts data B2 for the second color and the non-display data NC using the gamma compensation voltage for the second color received from the second voltage divider circuit 92 to output a B data voltage during the first horizontal period and then output the invalid data voltage during the second horizontal period. The B data voltage output from the fifth DAC 95B2 is applied to the third data line S3 through the third switch element M23 during the first horizontal period. A B sub-pixel 10B2 of the first pixel line L1 is charged with the B data voltage output from the fifth DAC 95B2 during the first horizontal period. The invalid data voltage is not transmitted to the third data line S3 because the third switch element M23 is in an off state during the second horizontal period.

The sixth DAC 95G2 is disposed in a sixth channel CH6 of the data driving unit 110. The sixth DAC 95G2 converts first and second data G2 and G4 for the third color, which are input from the serial-to-parallel converter 94, using the gamma compensation voltage for the third color received from the third voltage divider circuit 93 to output a first G data voltage during the first horizontal period and then output a second G data voltage during the second horizontal period. The first and second G data voltages output from the sixth DAC 95G2 are directly applied to a fourth data line S4 through an output buffer of the sixth channel CH6. A G sub-pixel 10G2 of the first pixel line L1 is charged with the first G data voltage output from the sixth DAC 95G2 during the first horizontal period. A G sub-pixel 10G4 of the second pixel line L2 is charged with the second G data voltage during the second horizontal period.

Figure 15:
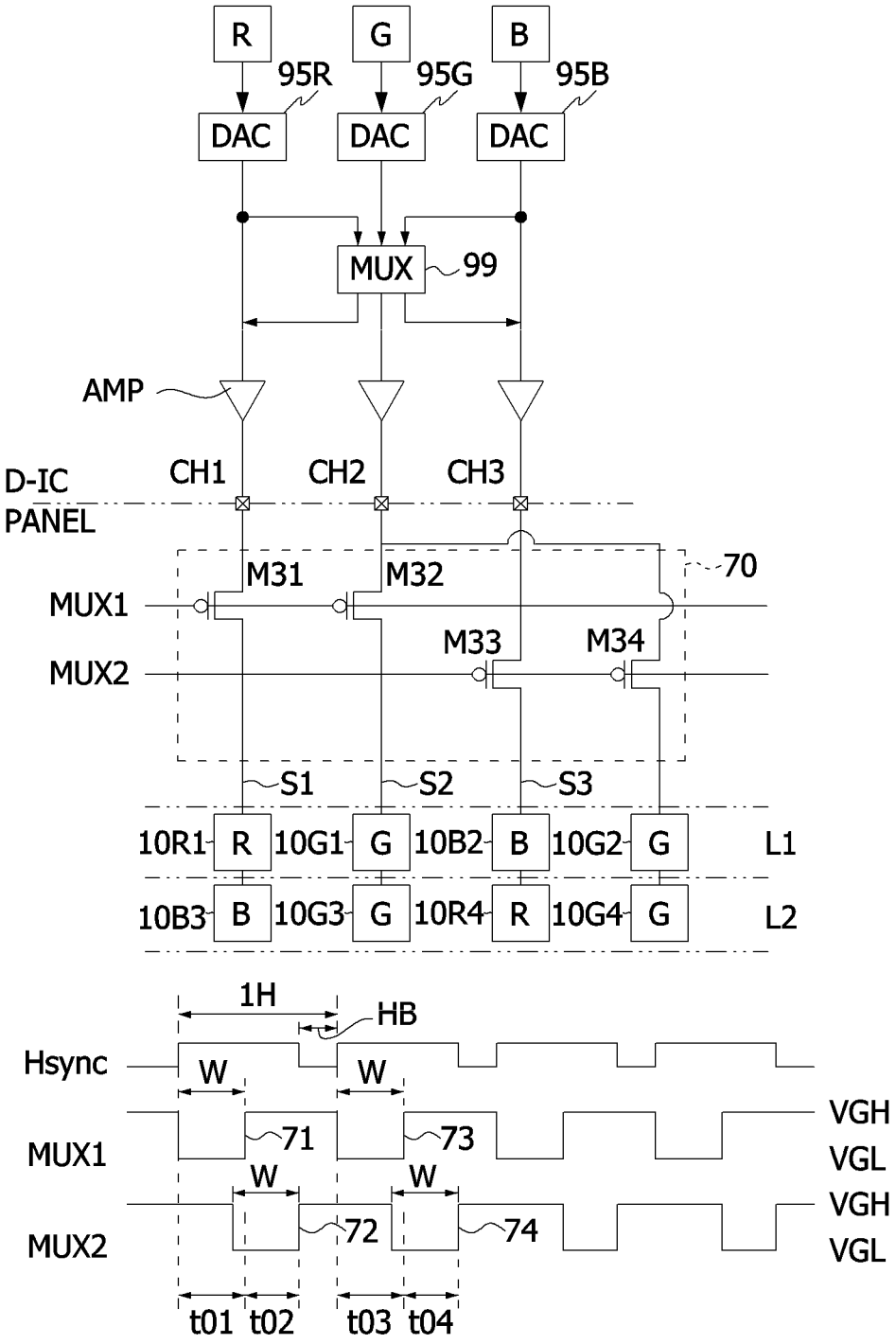
FIG. 15 is a diagram illustrating a data driving unit, a multiplexer, and a pixel array according to a fourth embodiment of the present disclosure.

FIG. 15 is a diagram illustrating a data driving unit, a multiplexer, and a pixel array according to a fourth embodiment of the present disclosure.

Referring to FIG. 15, a data driving unit 110 includes a first voltage divider circuit 91 configured to output a gamma compensation voltage for each grayscale of a first color, a second voltage divider circuit 92 configured to output a gamma compensation voltage for each grayscale of a second color, a third voltage divider circuit 93 configured to output a gamma compensation voltage for each grayscale of a third color, a first DAC 95R connected to the first voltage divider circuit 91, a second DAC 95G connected to the second voltage divider circuit 92, a third DAC 95B connected to the third voltage divider circuit 93, a first multiplexer 99 configured to switch paths of data voltages respectively output from the DACs 95R and 95B of first and third channels CH1 and CH3, and the like. The first voltage divider circuit 91 divides the gamma reference voltage R1-*n* for the first color to supply the gamma compensation voltage for each grayscale of the first color to the first DAC 95R. The second voltage divider circuit 92 divides the gamma reference voltage G1-*n* for the second color to supply the gamma compensation voltage for each grayscale of the second color to the second DAC 95G. The third voltage divider circuit 93 divides the gamma reference voltage B1-*n* for the third color to supply the gamma compensation voltage for each grayscale of the third color to the third DAC 95B. The gamma reference voltage for each color may be adjusted in level according to a register setting value of a programmable gamma IC and may be changed to a gamma reference voltage for another color.

The first DAC 95R is disposed in the first channel CH1 of the data driving unit 110. The first DAC 95R converts data R for the first color using the gamma compensation voltage for the first color received from the first voltage divider circuit 91. The second DAC 95G is disposed in a second channel CH2 of the data driving unit 110. The second DAC 95G converts data G for the second color using the gamma compensation voltage for the second color received from the second voltage divider circuit 92. The third DAC 95B is disposed in the third channel CH3 of the data driving unit 110. The third DAC 95B converts data B of the third color using the gamma compensation voltage for the third color received from the third voltage divider circuit 93.

The first multiplexer 99 is embedded in a driver IC D-IC in which the data driving unit 110 is integrated. The first multiplexer 99 is synchronized with a second multiplexer 70 disposed on a display panel PANEL. Under the control of the timing controller 130, the first multiplexer 99 supplies the data voltage for the third color, which is output from the third DAC 95B, to an output buffer of the first channel CH1 within a first half-period t03 of a second horizontal period and supplies the data voltage for the first color, which is output from the first DAC 95R, to an output buffer of the third channel CH3 within a second half-period t04 of the second horizontal period.

The second multiplexer 70 supplies the data voltages output from the channels CH1, CH2, and CH3 of the data driving unit 110 to the corresponding data lines S1 to S4 in response to MUX signals MUX1 and MUX2 generated from the timing controller 130. A pulse width W of each of the MUX signals MUX1 and MUX2 may be set to a half period of the remaining period obtained by subtracting a horizontal blank period HB from the one horizontal period 1H. A first pulse 71 of a first MUX signal MUX1 is generated as a gate-on voltage VGL during a first half-period t01 of a first horizontal period. A second pulse 73 of the first MUX signal MUX1 is generated as the gate-on voltage VGL during the first half-period t03 of the second horizontal period. A second MUX signal MUX2 is phase-delayed relative to the first MUX signal MUX1. A first pulse 72 of the second MUX signal MUX2 is generated as the gate-on voltage VGL during a second half-period t02 of the first horizontal period. A second pulse 74 of the second MUX signal MUX2 is generated as the gate-on voltage VGL during the second half-period t04 of the second horizontal period.

The second multiplexer 70 includes first to fourth switch elements M31, M32, M33, and M34 connecting the first to third channels CH1 to CH3 of the data driving unit 110 to the corresponding data lines S1, S2, S3, and S4.

A first switch element M31 is connected between the first channel CH1 of the data driving unit 110 and the first data line S1. The first switch element M31 is turned on in response to the first pulse 71 of the first MUX signal MUX1 in the first half-period t01 of the first horizontal period. At this point, the data voltage for the first color output from the first DAC 95R is supplied to the first data line S1 and is charged to an R sub-pixel 10R1. Subsequently, the first switch element M31 is turned on in response to the second pulse 73 of the first MUX signal MUX1 in the first half-period t03 of the second horizontal period. At this point, the first multiplexer 99 supplies the data voltage for the third color output from the third DAC 95B to the output buffer AMP of the first channel CH1, and the data voltage is supplied to the first data line S1 through the first switch element M31 to be charged to a B sub-pixel 10B3.

The second switch element M32 is connected between the second channel CH2 of the data driving unit 110 and the second data line S2. The second switch element M32 is turned on in response to the first pulse 71 of the first MUX signal MUX1 in the first half-period t01 of the first horizontal period. At this point, the data voltage for the second color output from the second DAC 95G is supplied to the second data line S2 to be charged to a G sub-pixel 10G1. Subsequently, the second switch element M32 is turned on in response to the second pulse 73 of the first MUX signal MUX1 in the first half-period t03 of the second horizontal period. At this point, another data voltage for the second color output from the second DAC 95G is supplied to the second data line S2 to be charged to a G sub-pixel 10G3.

The third switch element M33 is connected between the third channel CH3 of the data driving unit 110 and the third data line S3. The third switch element M33 is turned on in response to the first pulse 72 of the second MUX signal MUX2 in the first half-period t03 of the second horizontal period. At this point, the data voltage for the third color output from the third DAC 95B is supplied to the third data line S3 to be charged to a B sub-pixel 10B2. Subsequently, the third switch element M33 is turned on in response to the second pulse 74 of the second MUX signal MUX2 in the second half-period t04 of the second horizontal period. At this point, the first multiplexer 99 supplies the data voltage for the first color output from the first DAC 95R to the output buffer AMP of the third channel CH3, and the data voltage is supplied to the third data line S3 through the third switch element M33 to be charged to an R sub-pixel 10R4.

The fourth switch element M34 is connected between the second channel CH2 of the data driving unit 110 and the fourth data line S4. The fourth switch element M34 is turned on in response to the first pulse 72 of the second MUX signal MUX2 in the first half-period t03 of the second horizontal period. At this point, the data voltage for the second color output from the second DAC 95G is supplied to the fourth data line S4 to be charged to a G sub-pixel 10G2. Subsequently, the fourth switch element M34 is turned on in response to the second pulse 74 of the second MUX signal MUX2 in the second half-period t04 of the second horizontal period. At this point, another data voltage for the second color output from the second DAC 95G is supplied to the fourth data line S4 to be charged to a G sub-pixel 10G4.

In order to increase the response speed of the switch elements M31 and M32 in the second multiplexer 70, a rising edge and a falling edge may overlap between the pulses of the MUX signals MUX1 and MUX2.

Although omitted in FIG. 15, at least one of the output channels of the data driving unit may be directly connected to a corresponding data line, as in the example illustrated with reference to FIG. 20, so that the output voltage of the DACs 95R, 95G, or 95B may be directly applied to the corresponding data line. In FIG. 15, the colors of the sub-pixels may be changed while performing sub-pixel rendering, and the gamma reference voltage for each color applied to the DAC may be changed according to the changed colors of the sub-pixels. Meanwhile, the first multiplexer 99 of the data driving unit is substantially the same as multiplexers illustrated in FIG. 20.

Figure 16:
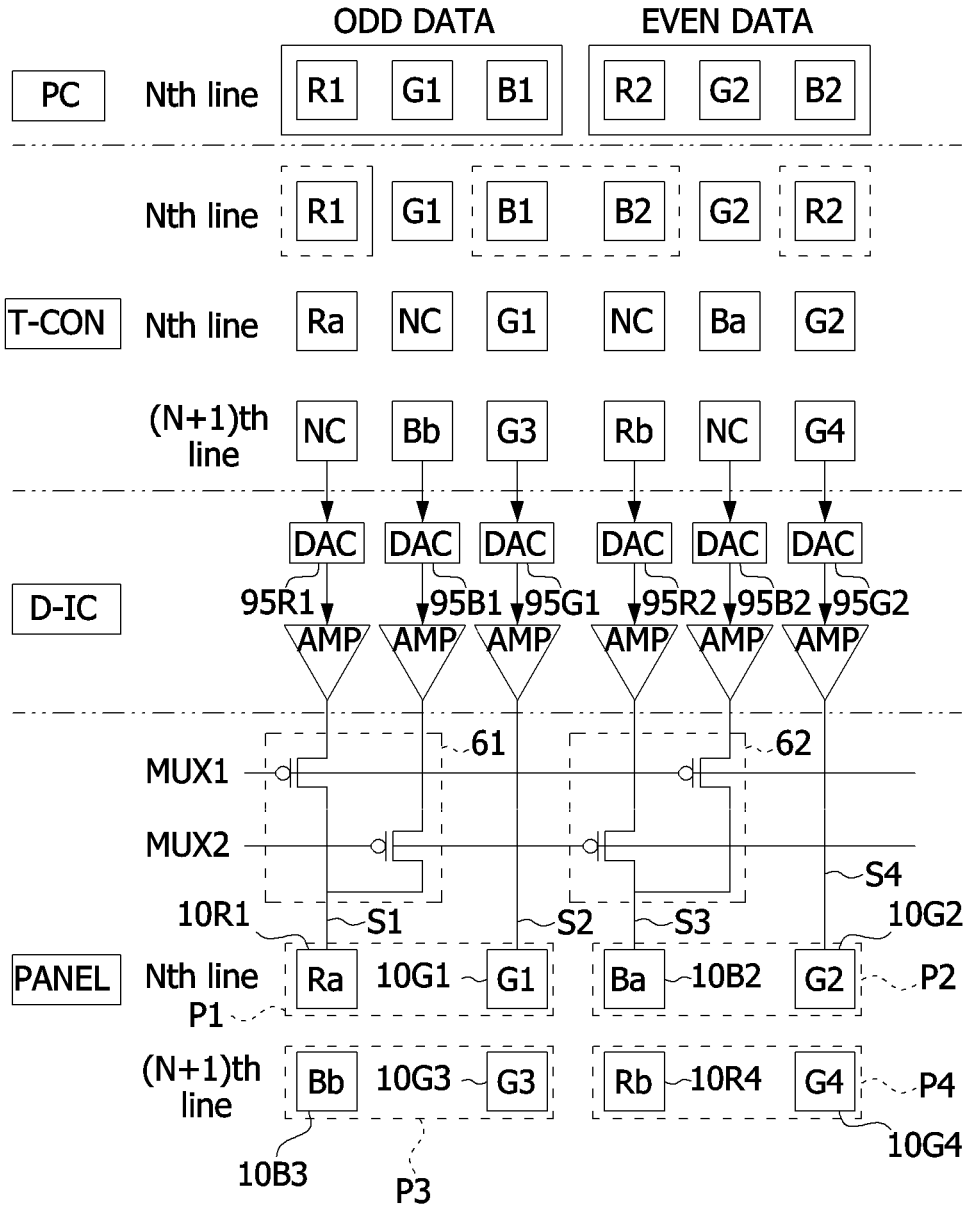
FIG. 16 is a diagram illustrating a data flow from a host system to a display panel.

FIG. 16 is a diagram illustrating a data flow from a host system to a display panel. In FIG. 16, "PC" represents a host system, "T_CON" represents a timing controller, "D-IC" represents a data driving unit, and "PANEL" represents a display panel.

Referring to FIG. 16, the host system PC may transmit odd-numbered pixel data ODD DATA to the timing controller T_CON through a first port and simultaneously transmit even-numbered pixel data EVEN DATA to the timing controller T_CON through a second port. The odd-numbered pixel data ODD DATA includes data R1, G1, and B1 to be written to odd-numbered pixels P1 and P3 of the display panel PANEL. The even-numbered pixel data EVEN DATA includes data R2, G2, and B2 to be written to even-numbered pixels P2 and P4 of the display panel PANEL. Each of the odd-numbered pixels P1 and P3 and the even-numbered pixels P2 and P4 may include two sub-pixels.

The timing controller T_CON rearranges pieces of the pixel data ODD DATA and EVEN DATA, which are input from the host system, according to a sub-pixel arrangement and modulates the data for some colors according to a preset sub-pixel rendering algorithm. For example, the timing controller T_CON modulates R data R1 and R2 among the neighboring pixel data into an average value Ra of the R data R1 and R2 and modulates B data B1 and B2 among the neighboring pixel data into an average value Ba of the B data B1 and B2. The timing controller T_CON may add preset non-display data NC to a position of empty data, which is generated as a result of modulating two pieces of data into one value, and arrange the data. The value of the non-display data NC may be set to a specific value, for example, zero, but the present disclosure is not limited thereto.

Figure 17:
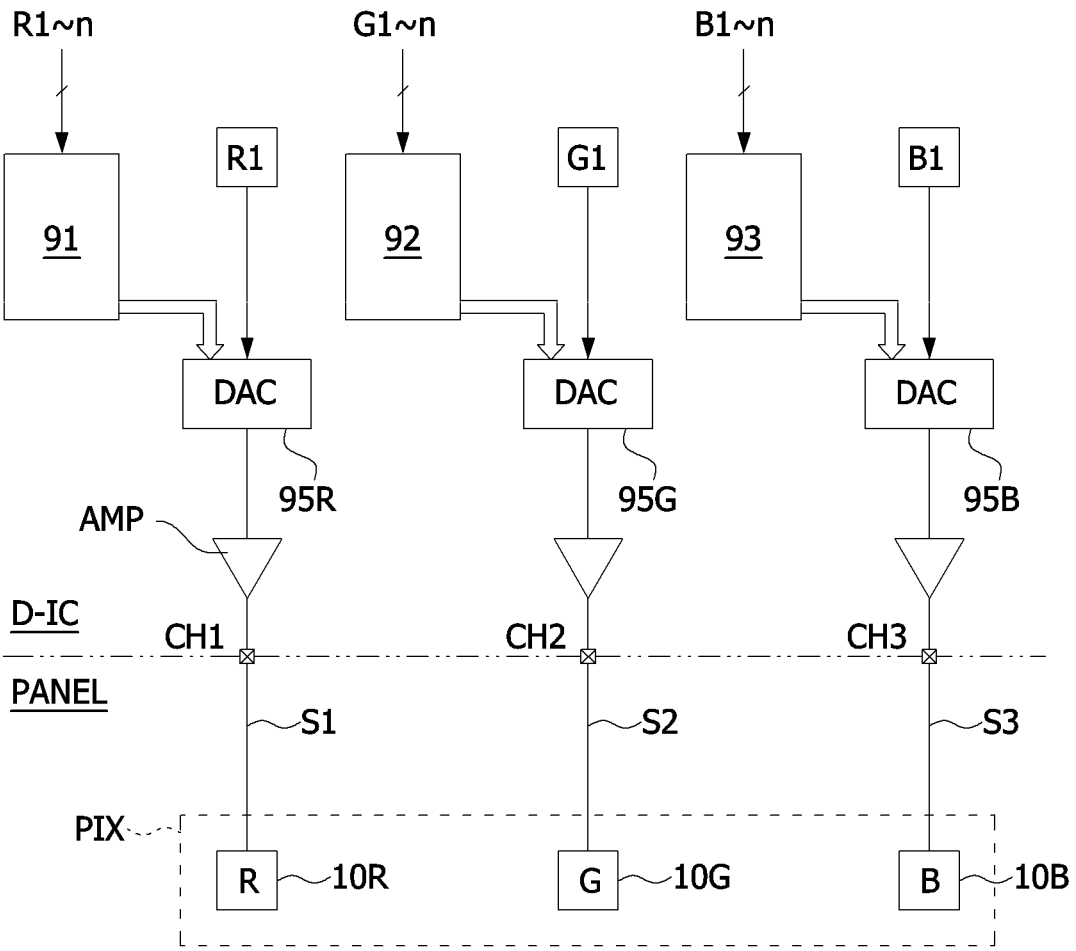
FIGS. 17 to 19 are diagrams illustrating examples in which a data driving unit having the same circuit configuration drives data lines of various display panels.
Figure 18:
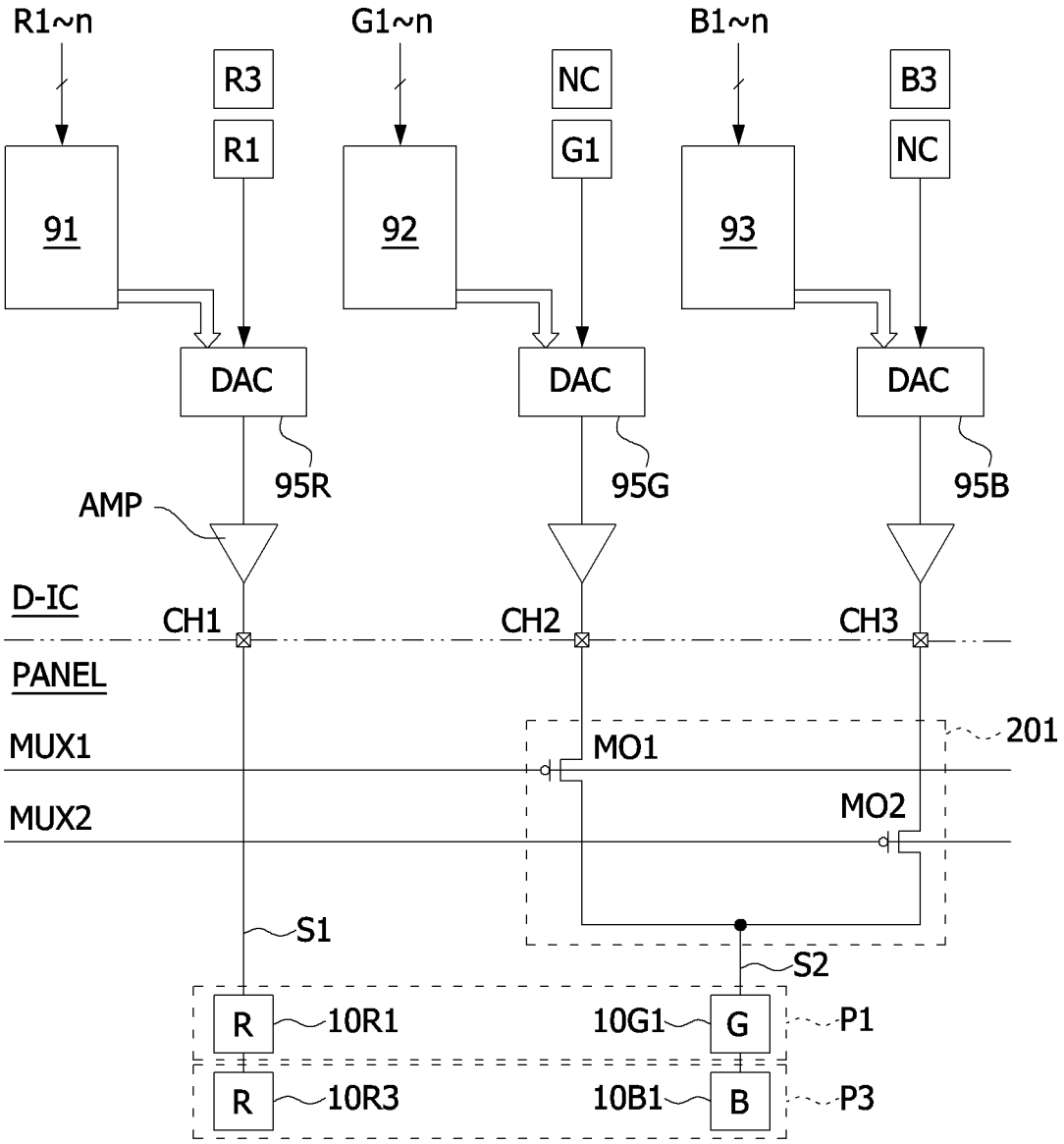
Figure 19:
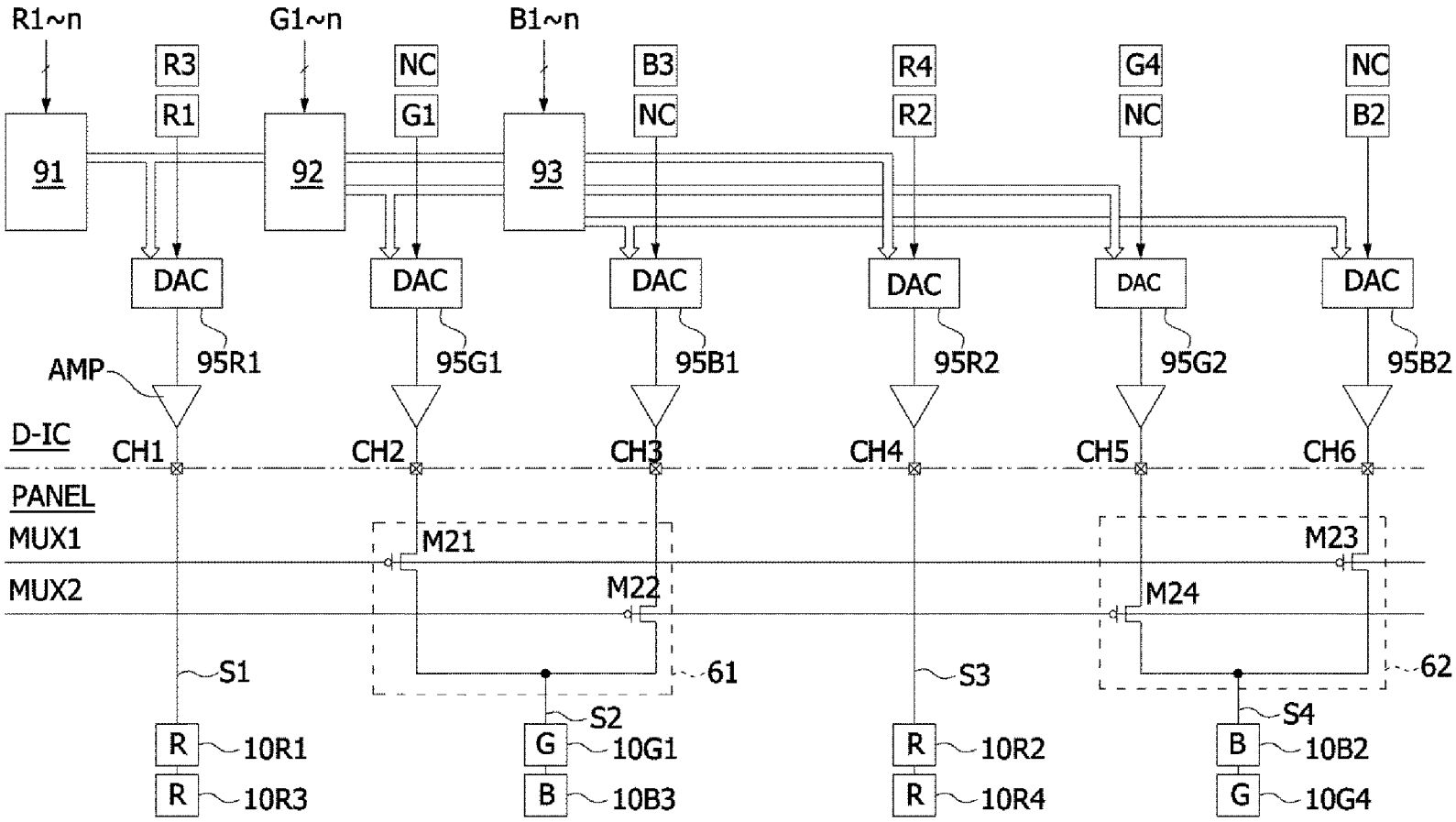

FIGS. 17 to 19 are diagrams illustrating examples in which a data driving unit having the same circuit configuration drives data lines of various display panels. Here, the various display panels refer to display panels in which sub-pixel rendering is designed differently depending on an application field. The diagrams illustrate examples in which a driver IC D-IC, in which the data driving unit is integrated, drives the data lines of the display panel in which pixels are arranged by sub-pixel rendering. In FIG. 17, one pixel PIX includes R, G, and B sub-pixels 10R, 10G, and 10B. In FIGS. 18 and 19, one pixel P1 or P3 includes two sub-pixels having different colors. In FIGS. 17 to 19, the driver ICs D-IC have substantially the same circuit configuration and may drive data lines of the display panels, on which sub-pixel rendering is variously performed, without degrading image quality. Thus, the driver IC D-IC may be used in common in various models of the display device.

Figure 20:
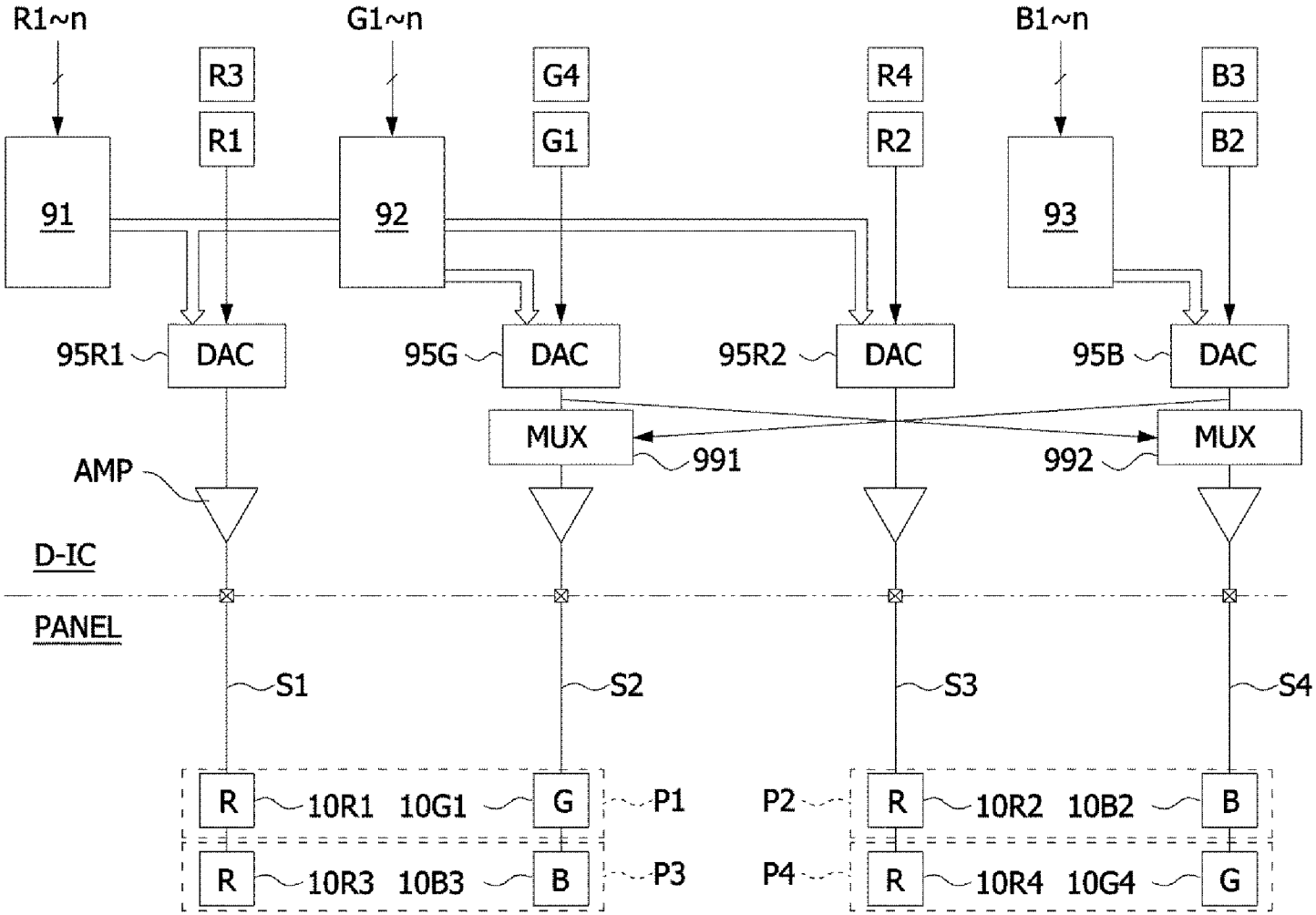
FIG. 20 is a diagram illustrating another embodiment of the multiplexer illustrated in FIG. 15.

FIG. 20 is a diagram illustrating another embodiment of the multiplexer illustrated in FIG. 15. The driver ICs shown in FIGS. 15 and 20 may be implemented with substantially the same circuit configuration and may be used in common in various models as the sub-pixel rendering is applied to different display panels.

Referring to FIG. 20, a data driving unit 110 includes first and second multiplexers 991 and 992. The first multiplexer 991 may supply an output voltage of a fourth DAC 95B to an input terminal of an amplifier AMP, which is disposed in a second channel CH2, under the control of the timing controller 130. The second multiplexer 992 may supply an output voltage of a second DAC 95G to an input terminal of an amplifier AMP, which is disposed in a fourth channel CH4, under the control of the timing controller 130. Thus, the data voltage output from the fourth DAC 95B may be charged to a B sub-pixel 10B3 through a second data line S2 connected to the second channel CH2. The data voltage output from the second DAC 95G may be charged to a G sub-pixel 10G4 through a fourth data line S4 connected to the fourth channel CH4.

Figure 21:
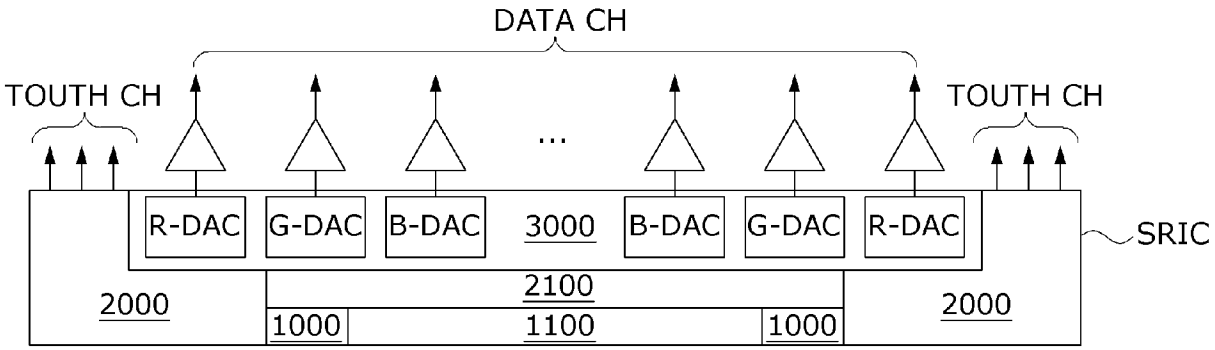
FIG. 21 is a schematic diagram illustrating a circuit configuration of a common driver integrated circuit (IC) in which a data driving unit and a touch sensor driving unit are integrated.

FIG. 21 is a schematic diagram illustrating a circuit configuration of a common driver IC in which a data driving unit and a touch sensor driving unit are integrated. In FIG. 21, "DATA CH" represents channels of a data driving unit, through which data voltages are output. "TOUCH CH" represents channels of a touch sensor.

Referring to FIG. 21, a driver IC SRIC includes a data signal processing unit 3000, a touch sensor driving unit 2100, a gamma compensation voltage generating unit 1000, an input/output interface unit 1100, and a touch channel unit 2000.

The input/output interface unit 1100 may include a receiving circuit through which pixel data of an input image is received and a transmitting circuit through which coordinate data of touch sensors is output. The gamma compensation voltage generating unit 1000 includes voltage divider circuits that independently generate gamma compensation voltages for each color as described above. The data signal processing unit 3000 includes a digital signal processing unit and an analog signal processing unit of the data driving unit 110. The digital signal processing unit includes a digital circuit of the serial-to-parallel converter. The analog signal processing unit includes DACs and output buffers. A first DAC R-DAC outputs a data voltage of a first color R using a gamma compensation voltage received from a first voltage divider circuit. A second DAC G-DAC outputs a data voltage for a second color G using the gamma compensation voltage received from the second voltage divider circuit. A third DAC B-DAC outputs a data voltage for a third color B using a gamma compensation voltage received from a third voltage divider circuit.

The touch sensor driving unit 2100 includes circuits that generate touch sensor driving signals and analyze output signals of the touch sensors with a preset touch recognition algorithm to generate touch coordinate data. Touch pads connected to the touch sensors, which are arranged on a pixel array of a display panel PNL, are arranged in the touch channel unit 2000.

The embodiments described above may be applied alone or in combination thereof.

According to the present disclosure, display panels of various models can be driven without degrading image quality by using a common data driving unit that includes a plurality of voltage divider circuits that each output an optimal gamma compensation voltage for each color and a plurality of digital-to-analog converters (DAC) that each output a data voltage using the gamma compensation voltage input from the voltage divider circuits. Thus, according to the present disclosure, a drive IC, in which the data driving unit is integrated, can be used in common in various display devices in which sub-pixel rendering is performed differently.

According to the present disclosure, pixels are driven with a gamma compensation voltage for each color, which is optimized for gamma characteristics of each color, so that image quality can be improved and charging time of the pixels can be increased. Furthermore, according to the present disclosure, even when a horizontal period is reduced due to an increase in resolution of a display panel, the charging time of the pixels can be secured.

Effects which can be achieved by the present disclosure are not limited to the above-mentioned effects. That is, other objects that are not mentioned may be obviously understood by those skilled in the art to which the present disclosure pertains from the following description.

Those skilled in the art can understand from the contents described above that various changes and modifications can be made without departing from the technical idea of the present disclosure. Therefore, the technical scope of the present disclosure should not be limited to the contents described in the detailed description of the specification.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A data driving circuit, comprising:

a first voltage divider circuit configured to output a gamma compensation voltage for a first color;

a second voltage divider circuit configured to output a gamma compensation voltage for a second color;

a third voltage divider circuit configured to output a gamma compensation voltage for a third color;

a first digital-to-analog converter (DAC) connected to the first voltage divider circuit and configured to convert input data for the first color using the gamma compensation voltage for the first color to output a data voltage of a first channel;

a second DAC connected to the second voltage divider circuit and configured to convert input data for the second color using the gamma compensation voltage for the second color to output a data voltage of a second channel; and a third DAC connected to the third voltage divider circuit and configured to convert input data for the third color using the gamma compensation voltage for the third color to output a data voltage of a third channel, wherein some of the channels are connected to data lines of a display panel through a multiplexer, and at least one of the channels is directly connected to a corresponding data line of the display panel.

2. The data driving circuit of claim 1, further comprising:

a first output buffer in the first channel and configured to output an output voltage of the first DAC to the display panel;

a second output buffer in the second channel and configured to output an output voltage of the second DAC to the display panel; and a third output buffer in the third channel and configured to output an output voltage of the third DAC to the display panel, wherein the multiplexer transmits the output voltage of the first DAC to an output buffer of another channel and transmits the output voltage of the third DAC to an output buffer of another channel.

3. A display device, comprising:

a display panel including a plurality of data lines, a plurality of sub-pixels for a first color, a plurality of sub-pixels for a second color, and a plurality of sub-pixels for a third color; and a data driving unit including:

a first voltage divider circuit configured to output a gamma compensation voltage for the first color;

a second voltage divider circuit configured to output a gamma compensation voltage for the second color;

a third voltage divider circuit configured to output a gamma compensation voltage for the third color;

a first digital-to-analog converter (DAC) connected to the first voltage divider circuit and configured to convert input data for the first color using the gamma compensation voltage for the first color to output a data voltage of a first channel;

a second DAC connected to the second voltage divider circuit and configured to convert input data for the second color using the gamma compensation voltage for the second color to output a data voltage of a second channel; and a third DAC connected to the third voltage divider circuit and configured to convert input data for the third color using the gamma compensation voltage for the third color to output a data voltage of a third channel, wherein the sub-pixels for the first color are charged with the data voltage output from the first channel, wherein the sub-pixels for the second color are charged with the data voltage output from the second channel, and wherein the sub-pixels for the third color are charged with the data voltage output from the third channel.

4. The display device of claim 3, further comprising a multiplexer configured to connect some of the channels of the data driving unit to the data lines of the display panel, wherein at least one of the channels of the data driving unit is directly connected to a corresponding data line of the display panel.

5. The display device of claim 3, wherein the data driving unit further includes a first output buffer disposed in the first channel to output an output voltage of the first DAC to the display panel, a second output buffer disposed in the second channel to output an output voltage of the second DAC to the display panel, and a third output buffer disposed in the third channel to output an output voltage of the third DAC to the display panel, and the multiplexer transmits the output voltage of the first DAC to an output buffer of another channel and transmits the output voltage of the third DAC to an output buffer of another channel.

6. A display device, comprising:

a display panel including sub-pixels for a first color connected to a first data line, and sub-pixels for a second color and a third color connected to a second data line;

a data driving unit including:

a first voltage divider circuit configured to output a gamma compensation voltage for the first color;

a second voltage divider circuit configured to output a gamma compensation voltage for the second color;

a third voltage divider circuit configured to output a gamma compensation voltage for the third color;

a first digital-to-analog converter (DAC) connected to the first voltage divider circuit and configured to convert input data for the first color using the gamma compensation voltage for the first color to output a data voltage of a first channel;

a second DAC connected to the second voltage divider circuit and configured to convert input data for the second color using the gamma compensation voltage for the second color to output a data voltage of a second channel; and a third DAC connected to the third voltage divider circuit and configured to convert input data for the third color using the gamma compensation voltage for the third color to output a data voltage of a third channel; and a multiplexer (MUX) configured to connect some of the channels of the data driving unit to corresponding data lines, wherein at least one of the channels of the data driving unit is directly connected to a corresponding data line.

7. The display device of claim 6, wherein the first channel of the data driving unit is connected to the first data line so that a data voltage for the first color, which is output from the first DAC during a first horizontal period and a second horizontal period, is continuously applied to the first data line.

8. The display device of claim 7, wherein the multiplexer includes:

a first switch element connected between the second channel and the second data line and configured to apply a data voltage for the second color, which is output from the second DAC, to the second data line in response to a first MUX signal during the first horizontal period; and a second switch element connected between the third channel and the second data line and configured to apply a data voltage for the third color, which is output from the third DAC, to the second data line in response to a second MUX signal during the second horizontal period.

9. The display device of claim 8, wherein the first DAC converts digital data for a first-first color, which is received in the first horizontal period, using the gamma compensation voltage for the first color to output a data voltage for the first-first color, and then converts digital data for a first-second color, which is received in the second horizontal period, using the gamma compensation voltage for the first color to output a data voltage of the first-second color, the second DAC converts digital data for the second color, which is received in the first horizontal period, using the gamma compensation voltage for the second color to output the data voltage for the second color, and then converts non-display digital data, which is received in the second horizontal period, using the gamma compensation voltage for the second color to output an invalid data voltage, the third DAC converts the non-display digital data, which is received in the first horizontal period, using the gamma compensation voltage for the third color to output the data voltage for the third color, and then converts digital data for the third color, which is received in the second horizontal period, using the gamma compensation voltage for the third color to output the invalid data voltage, and a transmission path of the invalid data voltage is blocked by the multiplexer.

10. A display device, comprising:

a display panel including a first sub-pixel for a first color and a first sub-pixel for a third color that are connected to a first data line, a first sub-pixel and a second sub-pixel for a second color that are connected to a second data line, a second sub-pixel for the third color and a second sub-pixel for the first color that are connected to a third data line, and a third sub-pixel and a fourth sub-pixel for the second color that are connected to a fourth data line;

a data driving unit including:

a first voltage divider circuit configured to output a gamma compensation voltage for the first color;

a second voltage divider circuit configured to output a gamma compensation voltage for the second color;

a third voltage divider circuit configured to output a gamma compensation voltage for the third color;

a first digital-to-analog converter (DAC) connected to the first voltage divider circuit and configured to convert input data for the first color using the gamma compensation voltage for the first color to output a data voltage of a first channel;

a second DAC connected to the second voltage divider circuit and configured to convert input data for the second color using the gamma compensation voltage for the second color to output a data voltage of a second channel;

a third DAC connected to the third voltage divider circuit and configured to convert input data for the third color using the gamma compensation voltage for the third color to output a data voltage of a third channel; and a fourth DAC connected to the second voltage divider circuit and configured to convert the input data for the second color using the gamma compensation voltage for the second color to output a data voltage of a fourth channel; and a first multiplexer and a second multiplexer that are configured to connect some of the channels of the data driving unit to corresponding data lines, wherein at least one of the channels of the data driving unit is directly connected to a corresponding data line.

11. The display device of claim 10, wherein the second channel is connected to the second data line so that a data voltage for the second color, which is output from the second DAC during a first horizontal period and a second horizontal period, is continuously applied to the second data line, and the fourth channel is connected to the fourth data line so that a data voltage for the second color, which is output from the fourth DAC during the first and second horizontal periods, is continuously applied to the fourth data line.

12. The display device of claim 11, wherein the first multiplexer includes a first switch element connected between the first channel and the first data line and configured to apply a data voltage for the first color, which is output from the first DAC, to the first data line in response to a first MUX signal during the first horizontal period, and a second switch element connected between the third channel and the first data line and configured to apply a data voltage for the third color, which is output from the third DAC, to the first data line in response to a second MUX signal during the second horizontal period, and the second multiplexer includes a third switch element connected between the third channel and the third data line and configured to apply the data voltage for the third color, which is output from the third DAC, to the third data line in response to the first MUX signal during the first horizontal period, and a fourth switch element connected between the first channel and the third data line and configured to apply the data voltage for the first color, which is output from the first DAC, to the third data line in response to the second MUX signal during the second horizontal period.

13. A display device, comprising:

a display panel including a first sub-pixel for a first color and a first sub-pixel for a second color that are connected to a first data line, a first sub-pixel and a second sub-pixel for a third color that are connected to a second data line, a second sub-pixel for the second color and a second sub-pixel for the first color that are connected to a third data line, and a third sub-pixel and a fourth sub-pixel for the third color that are connected to a fourth data line;

a data driving unit including:

a first voltage divider circuit configured to output a gamma compensation voltage for the first color, a second voltage divider circuit configured to output a gamma compensation voltage for the second color, a third voltage divider circuit configured to output a gamma compensation voltage for the third color, a first digital-to-analog converter (DAC) connected to the first voltage divider circuit and configured to convert input data for the first color using the gamma compensation voltage for the first color to output a data voltage of a first channel, a second DAC connected to the second voltage divider circuit and configured to convert input data for the second color using the gamma compensation voltage for the second color to output a data voltage of a second channel, a third DAC connected to the third voltage divider circuit and configured to convert input data for the third color using the gamma compensation voltage for the third color to output a data voltage of a third channel, a fourth DAC connected to the first voltage divider circuit and configured to convert the input data for the first color using the gamma compensation voltage for the first color to output a data voltage of a fourth channel, a fifth DAC connected to the second voltage divider circuit and configured to convert the input data for the second color using the gamma compensation voltage for the second color to output a data voltage of a fifth channel, and a sixth DAC connected to the third voltage divider circuit and configured to convert the input data for the third color using the gamma compensation voltage for the third color to output a data voltage of a sixth channel; and a first multiplexer and a second multiplexer that are configured to connect some of the channels of the data driving unit to corresponding data lines, wherein at least one of the channels of the data driving unit is directly connected to a corresponding data line.

14. The display device of claim 13, wherein the third channel is connected to the second data line so that a data voltage for the third color, which is output from the third DAC during a first horizontal period and a second horizontal period, is continuously applied to the second data line, and the sixth channel is connected to the fourth data line so that a data voltage for the third color, which is output from the sixth DAC during the first and second horizontal periods, is continuously applied to the fourth data line.

15. The display device of claim 14, wherein the first multiplexer includes a first switch element connected between the first channel and the first data line and configured to apply a data voltage for the first color, which is output from the first DAC, to the first data line in response to a first MUX signal during the first horizontal period, and a second switch element connected between the second channel and the first data line and configured to apply a data voltage for the second color, which is output from the second DAC, to the first data line in response to a second MUX signal during the second horizontal period, and the second multiplexer includes a third switch element connected between the fifth channel and the third data line and configured to apply a data voltage for the second color, which is output from the fifth DAC, to the third data line in response to the first MUX signal during the first horizontal period, and a fourth switch element connected between the fourth channel and the third data line and configured to apply a data voltage for the first color, which is output from the fourth DAC, to the third data line in response to the second MUX signal during the second horizontal period.

16. A display device, comprising:

a display panel including a first sub-pixel for a first color and a first sub-pixel for a third color that are connected to a first data line, a first sub-pixel and a second sub-pixel for a second color that are connected to a second data line, a second sub-pixel for the third color and a second sub-pixel for the first color that are connected to a third data line, and a third sub-pixel and a fourth sub-pixel for the third color that are connected to a fourth data line;

a data driving unit including:

a first voltage divider circuit configured to output a gamma compensation voltage for the first color, a second voltage divider circuit configured to output a gamma compensation voltage for the second color, a third voltage divider circuit configured to output a gamma compensation voltage for the third color, a first digital-to-analog converter (DAC) connected to the first voltage divider circuit and configured to convert input data for the first color using the gamma compensation voltage for the first color to output a data voltage to be output through a first channel and a third channel, a second DAC connected to the second voltage divider circuit and configured to convert input data for the second color using the gamma compensation voltage for the second color to output a data voltage to be output through a second channel, a third DAC connected to the third voltage divider circuit and configured to convert input data for the third color using the gamma compensation voltage for the third color to output a data voltage to be output through the first and third channels, and a first multiplexer configured to supply an output voltage of the first DAC to the third channel and supply an output voltage of the third DAC to the first channel.

17. The display device of claim 16, further comprising a second multiplexer configured to connect at least some of the channels of the data driving unit to corresponding data lines.

18. The display device of claim 17, wherein the second multiplexer includes a first switch element connected between the first channel and the first data line, a second switch element connected between the second channel and the second data line, a third switch element connected between the third channel and the third data line, and a fourth switch element connected between the second channel and the fourth data line, wherein the first switch element is turned on according to a first pulse of a first MUX signal to supply an output voltage of the first DAC to the first data line and then is turned on according to a second pulse of the first MUX signal, which is generated subsequent to a first pulse of a second MUX signal, to supply an output voltage of the third DAC, which is input through the first multiplexer, to the first data line, wherein the second switch element is turned on according to the first pulse of the first MUX signal to supply an output voltage of the second DAC to the second data line and then is turned on according to the second pulse of the first MUX signal to supply the output voltage of the second DAC to the second data line, wherein the third switch element is turned on according to the first pulse of the second MUX signal to supply the output voltage of the third DAC to the third data line and then is turned on according to a second pulse of the second MUX signal, which is generated subsequent to the second pulse of the first MUX signal, to supply the output voltage of the first DAC, which is input through the first multiplexer, to the third data line, and wherein the fourth switch element is turned on according to the first pulse of the second MUX signal to supply the output voltage of the second DAC to the fourth data line and then is turned on according to the second pulse of the second MUX signal to supply the output voltage of the second DAC to the fourth data line.

* * * * *